US009421816B2

(12) United States Patent
Stas

(10) Patent No.: US 9,421,816 B2
(45) Date of Patent: Aug. 23, 2016

(54) APPARATUS AND METHODS FOR DISPLAYING FABRIC BASED IMAGES

(71) Applicant: Daniel Stas, Woodland Hills, CA (US)

(72) Inventor: Daniel Stas, Woodland Hills, CA (US)

( * ) Notice: Subject to any disclaimer, the term of this patent is extended or adjusted under 35 U.S.C. 154(b) by 0 days.

(21) Appl. No.: 14/300,901

(22) Filed: Jun. 10, 2014

(65) Prior Publication Data

US 2015/0013200 A1 Jan. 15, 2015

Related U.S. Application Data

(60) Provisional application No. 61/845,960, filed on Jul. 13, 2013.

(51) Int. Cl.

| | |
|---|---|
| ***D06C 3/08*** | (2006.01) |
| ***B44D 3/18*** | (2006.01) |
| *A47G 1/06* | (2006.01) |

(52) U.S. Cl.

CPC ..... *B44D 3/185* (2013.01); *A47G 2001/0661* (2013.01); *Y10T 29/49826* (2015.01)

(58) Field of Classification Search

CPC ..... A47G 2001/0661; B44D 3/185

USPC ..... 40/780, 603, 604, 606.12; 38/102.1, 38/102.3, 102.91

See application file for complete search history.

(56) References Cited

U.S. PATENT DOCUMENTS

| | | | | | |
|---|---|---|---|---|---|
| 786,481 | A * | 4/1905 | Burdick | G09F 7/18 | 40/604 |
| 992,191 | A * | 5/1911 | Hammond | G09F 15/0037 | 40/606.12 |
| 2,385,002 | A * | 9/1945 | Jorgenson | G09F 1/06 | 40/603 |
| 3,591,940 | A * | 7/1971 | Slemmons | G09F 1/10 | 40/603 |
| 4,283,870 | A * | 8/1981 | Stetler | A47G 1/0605 | 40/780 |
| 6,003,253 | A * | 12/1999 | Abplanalp | B44D 3/185 | 160/404 |
| 6,070,351 | A * | 6/2000 | Verret | G09F 17/00 | 160/378 |
| 7,437,843 | B2 * | 10/2008 | Lefebvre | G09F 7/00 | 242/395 |
| 2007/0056200 | A1 * | 3/2007 | Ridless | G09F 17/00 | 40/603 |

* cited by examiner

*Primary Examiner* — Kristina Junge
(74) *Attorney, Agent, or Firm* — Trojan Law Offices

(57) ABSTRACT

A stretcher frame apparatus and methods for stretching and mounting a fabric, such as canvas, to a supporting surface, such as a wall. The apparatus has two opposing elongated frame members that are attached to opposite sides of a fabric. When the frame members are first mounted to the wall, the fabric will have slack, but the fabric is made taut when the user inserts removable elongated tension member(s) between the wall and rear side of the fabric. Preferably, two tension members are inserted between the wall and the mounted fabric and then slid in opposite directions toward the mounted frame members. This apparatus and method allows a user to forgo cumbersome four-sided box frames, and instead provides a simple, easy to use apparatus for mounting decorative fabric-based images to a wall.

21 Claims, 18 Drawing Sheets

APPARATUS AND METHODS FOR DISPLAYING FABRIC BASED IMAGES

CROSS-REFERENCE TO RELATED APPLICATIONS

This patent application claims the benefit of U.S. Provisional Patent Application No. 61/845,960, filed Jul. 13, 2013.

FIELD OF THE DISCLOSURE

The present invention relates to an apparatus and methods for displaying fabric based images. Specifically, the apparatus mounts, stretches and frames fabric on a wall, without the use of a four-sided frame. The present invention is particularly suitable for canvas art.

BACKGROUND OF THE INVENTION

Fabrics such as artist's canvases have been mounted and displayed on walls using a variety of devices and methods. In recent years, inkjet canvas prints or "giclees," have become increasingly popular. They are mass produced and relatively inexpensive when compared to currently available mounting and framing options. Canvases are usually stretched on four-sided frames in order to make the image surface as flat as possible. This often requires professional expertise and adds the inconvenience of working with a frame shop. Furthermore, merely stretching the canvas does not provide decorative framing. Frames need to be purchased separately, further adding to the overall cost of displaying images. In most cases, these extra expenses by far exceed the cost of the canvas prints themselves.

There are several Do-It-Yourself (DIY) canvas stretcher frame kits available for professional and amateur consumers on the market today, but they can be expensive, time consuming, and complicated to assemble. Also, most kits employ a four-sided frame, which greatly limits the size options for the user, in both length and width dimensions. For example, long panoramic works or mural size images cannot be accommodated by these DIY kits at all, and instead require custom-built frames. When these large mounted artworks need to be shipped, there are additional challenges, including shipping size restrictions and costly surcharges for oversized packages. Mural sized artwork can also be painted directly on a wall, or a large scaled fabric can be adhered to the wall. These methods present the problems of the paint medium, the challenge of the materials to be adhered, and the difficulty removing and saving artwork if a building is modified or demolished. Therefore, there remains a need for versatile and cost-effective Do-It-Yourself stretcher frame kits that allow for canvases of any size to be easily mounted and framed on the wall and just as easily to be disassembled for moving or shipping.

BRIEF SUMMARY OF THE PRESENT INVENTION

The embodiments of the present invention are directed to methods and apparatus for mounting, stretching and framing canvas art or prints on a wall, but may be used for other types of fabric sheet materials and installation on other types of supporting surfaces.

Embodiments of this apparatus employ new methods for mounting, tensioning and framing fabric based images, such as canvas art, prints, graphic banners and signs, directly on a supporting surface, such as a wall, by framing it on two opposing sides and achieving a uniform tautness of the displayed image. This new system stretches the fabric on two sides only, in a single linear direction, as opposed to the traditional four-sided frames. This two sided framing is accomplished through the attachment of opposite edges of the fabric sheet to two opposing frame members which are mounted directly onto the wall, then increasing the tautness of the fabric using tension members, which are inserted between the wall and the fabric. What is created is a unique and attractive wall mounted art display that is stretched and framed on just two sides, within minutes. Since the apparatus employs only two-sided framing, unlike the traditional four-sided boxed systems, it removes all limitations upon the length size of a single display image. Such displays, regardless of their size, can be easily assembled and disassembled in minutes, by professional or amateur consumers. Furthermore, the apparatus does not typically require the use of specialized equipment like stretching pliers or a staple gun. Instead, the kit utilizes mostly screws and adhesive tape, which are included with it. When disassembled, the display kit is very compact in size and lightweight, making it very portable, thus greatly facilitating storage and economic shipment domestically as well as internationally.

By the term "fabric," it is meant any sufficiently flexible and/or resilient material, typically in the form of a sheet. When used herein, the term "fabric" includes inkjet print canvas made from cotton, or polyester, or a blend of the two (poly/cotton), traditional woven cotton canvas, linen canvas, knitted fabrics, woven and non-woven natural and man-made fabrics, paper and plastic. By the term "supporting surface" it is meant any substantially flat, rigid surface such as a board, panel, door or a wall.

In a first embodiment of the present invention, the stretcher frame apparatus comprises a first elongated frame member, and an opposing second elongated frame member. The first and second elongated frame members are capable of being secured to a fabric having a front surface (image side) and a rear surface, opposing first and second edges, and opposing third and fourth edges. The first elongated frame member is capable of being secured to the fabric along the first edge and the second elongated frame member is capable of being secured to the fabric along the second edge. The term "along" is defined as on the edge itself, at or near the edge, or in close proximity to the edge, but necessarily on an edge surface. The first and second elongated frame members are also capable of being mounted to a supporting surface, such as a wall. Between the first and second elongated frame members is a removable elongated tension member capable of insertion between the first and second elongated frame members and insertion between the fabric and the supporting surface. When the elongated tension member is inserted between the supporting surface and the fabric, the elongated tension member increases the distance between the supporting surface and the fabric, thereby increasing tautness of the fabric when the fabric is mounted to the wall via the first and second elongated frame members.

The two substantially parallel positioned elongated frame members are mounted directly to a supporting surface such as a wall, by means of screws, bolts or equivalent fastening means, mounted to the wall with the fabric extended tightly between them, keeping the fabric suspended either in a horizontal or a vertical position. The level of the fabric sheet surface parallel to the wall surface (the space between the fabric and the wall) is shorter than the height (depth) of the elongated tension member(s). When the tension member is inserted between the fabric and the wall, it protrudes or raises the fabric sheet away from the wall, and thus stretches it, thereby increasing tautness of the fabric.

In another embodiment, there are a plurality of elongated tension members, and in yet another embodiment there are two elongated tension members that are inserted between the wall and the fabric. Frame members and tension members are elongated and may be of any hollow or solid cylindrical shape, triangular shape, V-shaped, L-shaped, curved (round), or a combination of these shapes. In an embodiment that has a plurality of elongated tension members, at least one tension member is also shaped to fit around a corner of the wall, allowing for corner-mounted displays.

In an embodiment that has two removable elongated tension members, the tension members can be spaced from each other at any desirable distance and substantially spaced from the two opposing elongated frame members, creating a multi-planar display, and in yet another embodiment, the tension members are spaced from each other so that the first tension member is near or adjacent to the first frame member, and the second tension member is near or adjacent to the opposing second frame member, creating a display with a single plane.

In another embodiment, the apparatus further comprises a plurality of edge strip members capable of attaching to the rear surface of the edge of the fabric along the third and fourth edges not mounted to the wall. These edge strip members reinforce the unmounted loose edges of the fabric.

In another embodiment of the present invention, a protective container, such as a cylindrical tube, is provided that has an elongated slit running lengthwise down the tube. The slit permits the canvas to fit through but does not permit the framing members to fit through. Depending on the size of the framing member(s), this protective container permits the fabric sheet to be rolled and inserted into the container, with at least a portion of the fabric passing through the slit, with one of the framing members on the outside of the tube. It also permits the fabric sheet to be rolled around the outside of the container, with at least a portion of the fabric passing through the slit, with one of the framing members on the inside of the tube.

In another embodiment, a method of mounting and tensioning the fabric is provided. The method includes the steps of securing a fabric to two elongated frame members along its opposing edges, mounting the two elongated frame members to a supporting surface such as a wall, and then inserting one or more removable elongated tension members between the first and second elongated frame members, and between the fabric and the wall. The two elongated frame members and the removable elongated tension member(s) are all substantially parallel to each other. The user may slide the one or more tension members towards the edge of the fabric (near the frame members) to increase the tautness of the fabric. To further control tautness, the tension members may be rotated to increase or decrease the distance between the wall and the fabric when the fabric is mounted.

In yet another embodiment, the method includes the steps of mounting the first elongated frame member to a wall, then placing the first elongated tension member under the fabric sheet, as the fabric is being extended. This holds the first elongated tension member in place, while the second elongated frame member is being mounted to the wall. After the second elongated frame member is mounted to the wall, the second elongated tension member is inserted between the second elongated frame member and the first elongated frame member. The user eventually slides both tension members towards the edges of the fabric sheet (near the frame members) to increase the tautness of the fabric. In another embodiment, the step of mounting includes placing the first elongated tension member on the corner of the wall before the second elongated frame member extends the fabric over the first elongated tension member and mounts the fabric around a corner of the wall, creating a corner-mounted display.

It is an aim of this invention to make canvas stretching and frame display a very quick, simple, and cost effective experience for the average consumer to execute themselves at home, while at the same time stimulating their creativity. As will be shown, the apparatus employs flexible methods capable of many different installation options and decorative looks for the displayed image of any size.

DETAILED DESCRIPTION OF EMBODIMENTS

Figure 1A:
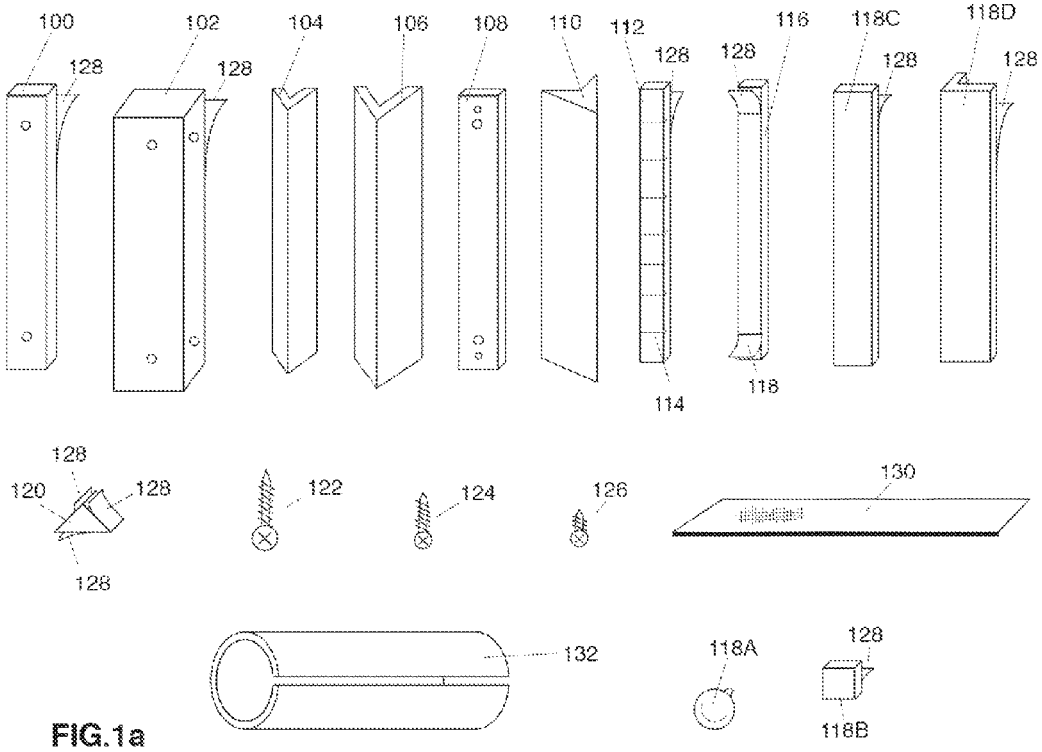
FIG. 1*a* is an isometric view of a collection of various elements that may be employed in a kit for mounting fabric canvas.

The following discussion addresses a number of embodiments and applications of the present disclosure. Reference is made to the accompanying drawings that form a part hereof, and are shown by way of illustration of specific embodiments in which the disclosure may be practiced. It is to be understood that other embodiments may be utilized and changes may be made without departing from the scope of the present disclosure.

The beneficial features of the present disclosure will be illustrated by way of artist's fabric canvas, often referred to in the field of artistic painting or commercial printing simply as a "canvas." It is to be understood that the present disclosure is not limited to such specific application and that numerous implementations of the present disclosure may be realized. The canvas, however, presents an apposite example for enabling a skilled artisan to practice the inventive concept.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below. Finally, many of the steps are presented below in an order intended only as an exemplary embodiment. Unless logically required, no step should be assumed to be required earlier in the process than a later step simply because it is written first in this document.

DRAWINGS—REFERENCE NUMERALS

The kit elements can be made of any suitable material. Contemplated materials include wood, plastics, metals, cardboard, and other compositions that provide sufficient stiffness. The kit elements are reproduced here with the following reference numbers for convenience:

100 elongated frame member (small, rectangular)
102 elongated frame member (large, rectangular)
102A elongated frame member (half-round)
102B elongated frame member (solid cylindrical)
102C elongated frame member (hollow cylindrical)
104 removable elongated tension member (small, V-shaped)
106 removable elongated tension member (large, V-shaped)
106A removable elongated tension member (hollow half-round)
106B removable elongated tension member (hollow cylindrical)
106C removable elongated tension member (hollow quarter-round)
106D removable elongated tension member (triangular)
106E removable elongated tension member (rectangular)
106F removable elongated tension member (solid cylindrical)
108 frame plate
110 removable elongated corner tension member (round)
112 elongated edge strip member
114 notch (predetermined breakpoint)
116 elongated cross support strip
118A screw cap
118B ornamental screw cover
118C frame cover (one-sided)
118D frame cover (corner-shaped)
120 edge support member
122 wall screw
124 frame screw
126 plate screw
128 adhesive strip
130 canvas sheet (fabric)
132 tube with slit (protective container)
134 wall Turning now to the drawings, FIG. 1*a* is a collection of isometric views of the various elements that may employed in a kit for mounting canvas sheet 130 in accordance with the present invention. The various elements will be seen to be selectively employed in the following figures to mount the canvas 130 in ways that create various functional and aesthetic effects and to facilitate shipping.

Figure 1B:
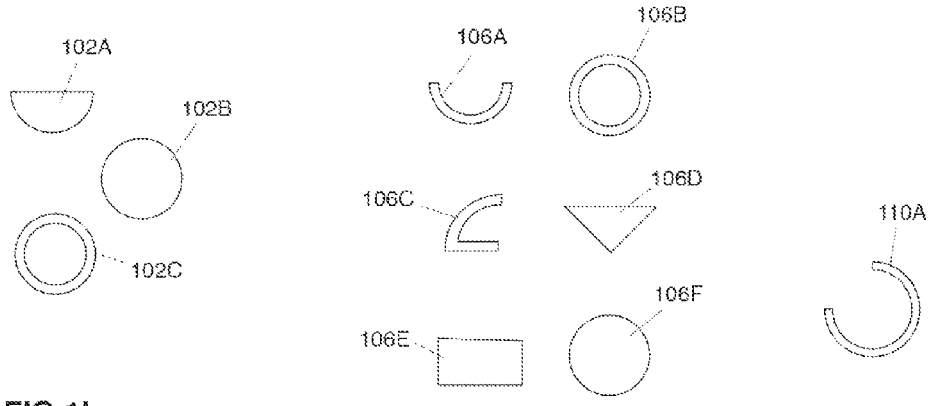
FIG. 1*b* is an end view of a collection of frame and tension elements in a variety of different shapes, which will be referenced throughout the figures.

FIG. 1*b* is a series of end views of different shapes of the frame members and tension members, both of which may be of any desired cross-section. While the collection of the elements illustrated in FIG. 1*a* is presented as representative of those that may be found in a kit for mounting canvas in accordance with the present invention, it will be illustrated throughout following figures that shape and character (i.e. triangular versus cylindrical) of elements illustrated here in FIG. 1*b* can be used to produce subtly different mountings that result in different appearances of the displayed art. The different sizes and shapes show that the present invention is capable of many different embodiments and may be carried out in various ways with different aesthetic but also functional effects.

Figure 2A:
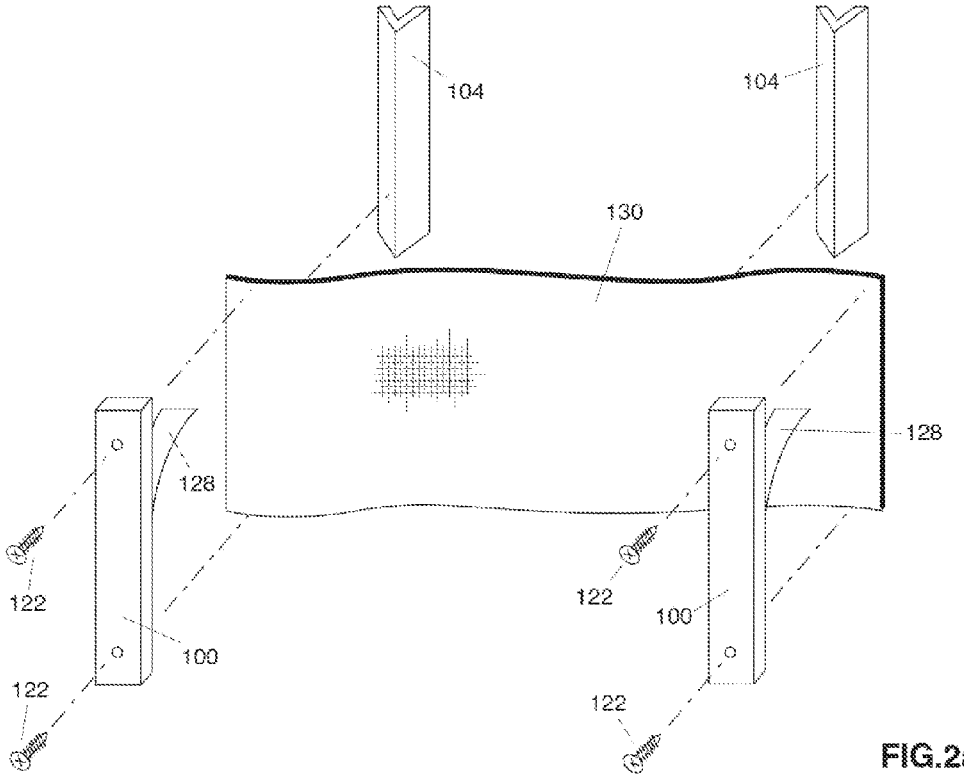
FIG. 2*a* is a front exploded isometric view of a basic embodiment of the mounting apparatus in its horizontal position, prior to its assembly.

FIG. 2*a* is an exploded front isometric view of a basic embodiment of the apparatus in its horizontal position, prior to its assembly. It comprises one pair of elongated frame members 100 and one pair of elongated removable tension members 104. For illustration purposes, elongated frame members 100 will refer to small frame members of generally rectangular shape, whose height (depth) is no greater than 1.3 cm (0.5 inch) and the width is no greater than 2.5 cm (1 inch), to differentiate them from large elongated frame members 102 (not shown here) which can be of any desired larger size. Similarly, the elongated removable tension members 104 will refer to small tension members similar in size to the frame members 100, to differentiate them from large tension members 106 (not shown here). A typical tension member can be of any desired cross-sectional shape, but for purposes of the following illustrations the tension members 104 will be of a V-shape. Each small elongated frame member 100 has at least two holes drilled through its front and back side for receiving wall screws 122 or frame screws 124 (not shown). On its rear side, the frame member 100 has a double-sided mounting tape or adhesive strip 128 used for adhering it to the edge of the canvas sheet 130, and optionally also at least two small openings for optional receipt of plate screws 126. Although adhesive double-sided tape and screws are used in illustrations as the main connecting method for most elements, any other suitable means for connections between the apparatus elements and canvas 130 can be used, such as liquid adhesive, glue, tacks, nails, staples or the like.

Figure 2B:
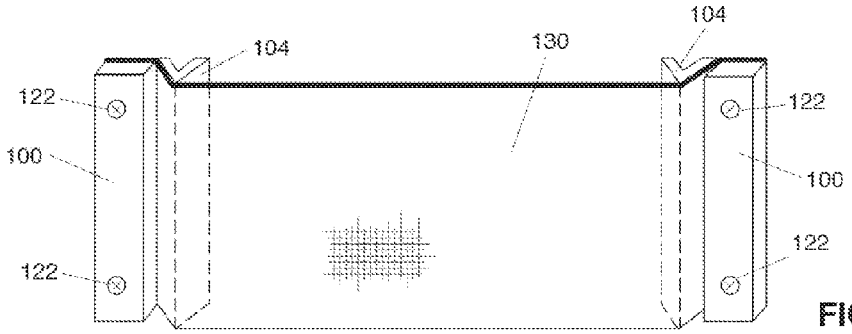
FIGS. 2*b*-2*c* are front isometric and top side elevation views of the apparatus after it has been assembled, with the canvas mounted horizontally to a wall.
Figure 2C:
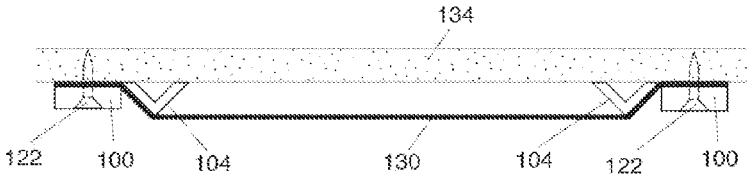

FIGS. 2*b*-2*c* show front isometric and top side elevation views of the assembled apparatus as it is mounted to a supporting surface such as a wall 134 (not shown in FIG. 2*b*). The canvas sheet 130 has a front surface (image side) and a rear surface (facing the wall), and four edges, opposing first and second edges and opposing third and fourth edges. Here, the canvas 130 is displayed in a horizontal (landscape) position, with the image side facing the front. The canvas 130 is mounted along its opposing first and second edges to the wall 134 via first and second elongated frame members 100 and is in a uniform taut state. The first edge of the canvas is sandwiched between the first elongated frame member 100 and the wall 130, and the second edge of the canvas is sandwiched between the second elongated frame member 100 and the wall 130. On each side, the small frame members 100 and small tension members 104 are near or adjacent to each other in parallel positions. FIG. 2*c* is a top side elevation view looking down at the apparatus as it is mounted to the wall 134 with frame screws 122.

Figure 3A:
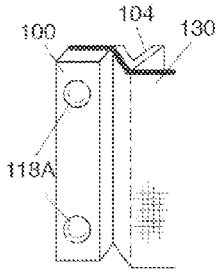
FIGS. 3*a*-3*d* are partial front isometric views of various cosmetic finishes.
Figure 3B:
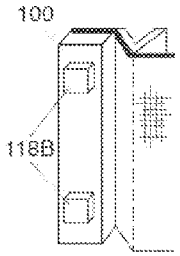
Figure 3C:
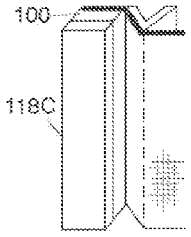
Figure 3D:
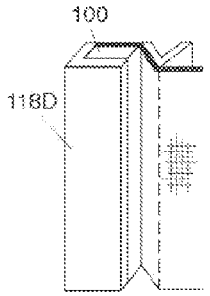

FIGS. 3*a*-3*d* are a series of partial isometric views illustrating the application of various cosmetic finishes that may be used on elongated frame members 100 to cover up the wall screws. In some instances, screws can be left in plain view for a "rustic" appearance of the frame members 100, such as when stained wood is used. FIG. 3*a* illustrates the use of the simplest cosmetic finish in form of screw caps 118A. FIG. 3*b* illustrates the use of square-shaped ornamental screw covers 118B, which would serve as a decorative addition to the frame members 100 while at the same time hiding the screws from the view. FIG. 3*c* illustrates a one-sided frame cover 118C, which gives the frame member 100 a smooth finish along its frontal side. In FIG. 3*d*, a corner-shaped cover 118D is used, providing a smooth finish to both sides of the frame member 100. Cosmetic covers can be applied by means of adhesive tape, magnets or by means of friction grip such as press-on and snap-on. The following figures will be illustrated without the use of cosmetic finishes, for greater simplicity and clarity of the figures.

Figure 4A:
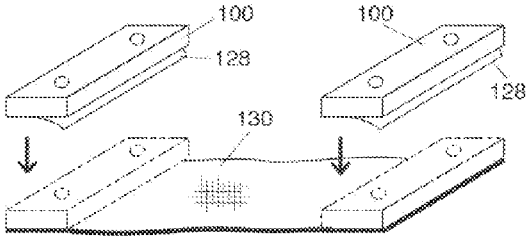
FIGS. 4*a*-4*d* are isometric and side elevation views, demonstrating the attachment of the canvas sheet to the apparatus.
Figure 4B:
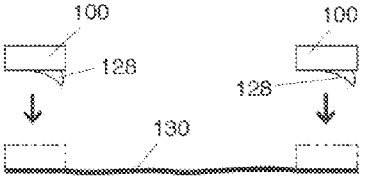
Figure 4C:
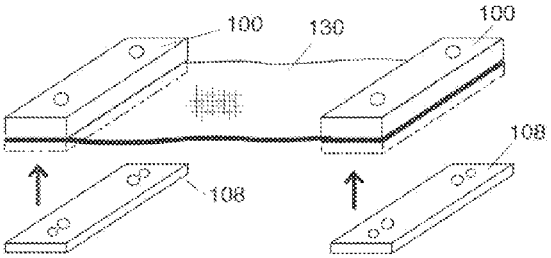
Figure 4D:
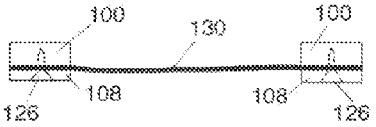

FIGS. 4*a*-4*d* illustrate the attachment of the small elongated frame members 100 to the opposing first and second edges of the canvas 130. FIG. 4*a* is an isometric view of the canvas sheet 130 after it has been placed down on a horizontal surface, image (artwork) side up. It is presumed that the canvas has a blank white border extending beyond the image along its opposing first and second edges. The blank borders should be trimmed down and be at least slightly narrower than the width of the frame members 100, to be used for attachment. The frame members 100 are aligned with the blank canvas borders and pressed down, one at the time, with its adhesive strip 128 side down (after the adhesive protective cover has been removed). This will keep the edges of the canvas sheet 130 temporarily secured to the frame members 100. FIG. 4*b* illustrates the same process in a side elevation view. FIGS. 4*c*-4*d* are isometric and side elevation views respectively, illustrating an optional application of frame plates 108, which can be used to secure the canvas edges 130 to the frame members 100 more permanently. The plates 108 have at least two holes drilled through its wider front and back sides for receiving of plate screws 126, and also at least two holes drilled through both wider sides for receiving of frame screws 122. The plates 108 are aligned and placed against the frame members 100 from the bottom (rear surface) as seen in FIG. 4*c*. FIG. 4*d* shows the frame plates 108 secured to the frame members 100 with plate screws 126. However, this should not be necessary in most instances. For this reason and for simplification of illustrations, frame plates 108 will not be used or illustrated in the following figures. Alternatively, the frame members 100 can be secured to the canvas edges more permanently using staples.

Figure 4E:
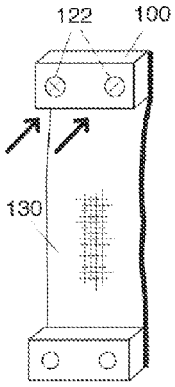
FIGS. 4*e*-4*l* are front isometric and right side elevation views of the canvas being mounted to a wall in a vertical position.
Figure 4F:
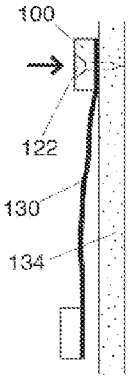
Figure 4G:
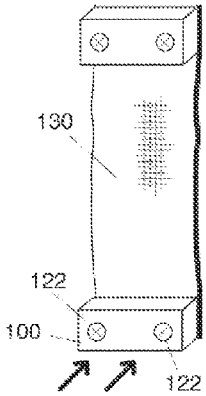
Figure 4H:
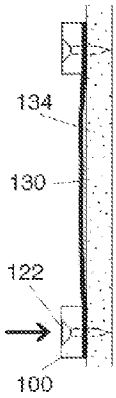
Figure 4I:
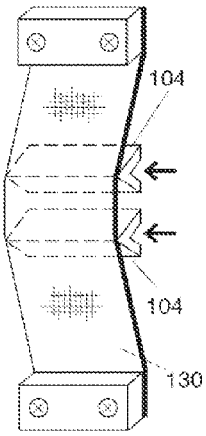
Figure 4J:
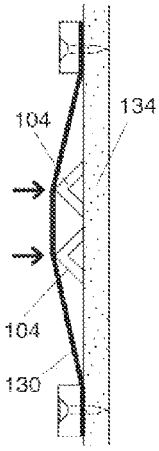
Figure 4K:
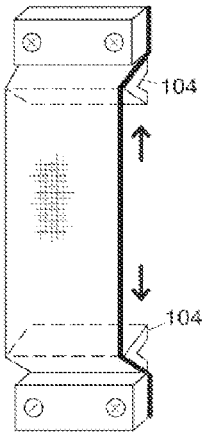
Figure 4L:
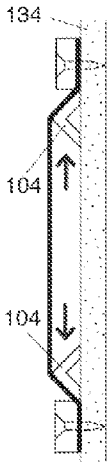

FIGS. 4*e*-4*l* show a series of views illustrating the method of mounting and tensioning of the canvas 130 in a vertically oriented display (portrait mode), in accordance with the present invention. In FIGS. 4*e*-4*f*, front isometric and right side elevation views respectively, the first (top) small elongated frame member 100 is screwed to the wall using wall screws 122. Pinning the first edge of the canvas 130 directly to the wall with the first frame member 100 on top of it (sandwiching the canvas edge between the wall and the frame member) secures the canvas firmly. For this reason the frame plates 108 illustrated earlier in FIGS. 4*c*-4*d* should not be usually required. However, the plates 108 may be necessary if the mounting takes place on a heavily textured surface. In the second step, shown in FIGS. 4*g*-4*h*, the second (bottom) small elongated frame member 100 which is secured to the opposing second edge of the sheet 130, is extended as far as the canvas sheet 130 allows and is mounted to the wall 134, again using wall screws 122. At this stage, the canvas is laying relatively flat on the wall surface, but is not perfectly flat. This would be difficult to achieve by these two steps alone, no matter how hard one "pulls" the canvas to extend it. For this reason, small V-shaped elongated tension members 104 are employed, as shown in FIGS. 4*i*-4*j*. They are inserted either one at the time or both at the same time, under the canvas 130 between it and the wall 134, in position substantially parallel to the frame members 100. This pushes the canvas 130 away from the wall 134 and stretches it further. The tensioners 104 are ideally inserted near the center of the sheet 130, where the tension in the sheet is minimal. In the last step, shown in FIGS. 4*k*-4*l*, the tensioners 104 are slid outwardly, toward the secured first and second edges, gradually increasing tension and "tightening" the appearance of the sheet 130. By the time the tension members 104 are near or adjacent to the frame members 100, a uniform tautness of the sheet 130 should be achieved. Because the tension members 104 pull the sheet 130 further from the wall, which in turn creates a pulling force on frame members 100, it's recommended to mount frame members 100 to the wall 134 with fastening means that preferably have threads, such as screws or bolts. The threads offer more holding power (strength) in terms of being pulled out.

Figure 5A:
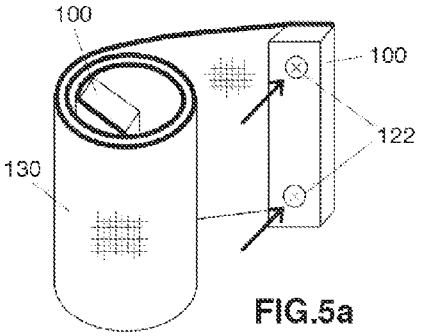
FIGS. 5*a*-5*j* are front isometric and top side elevation views of the canvas being mounted to a wall in a horizontal position.
Figure 5B:
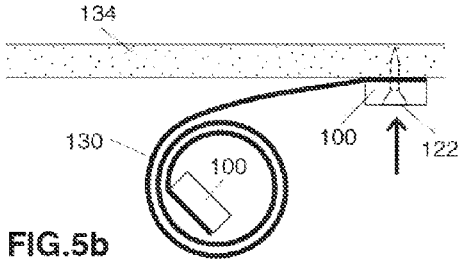
Figure 5C:
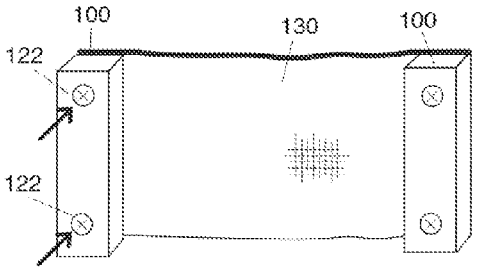
Figure 5D:
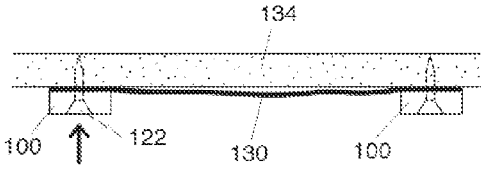
Figure 5E:
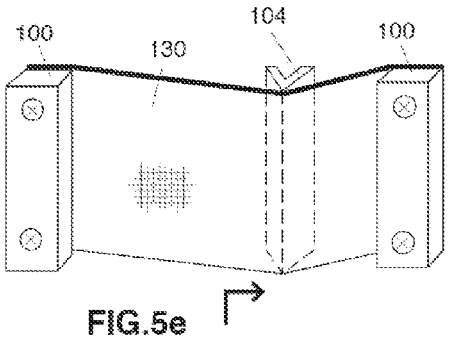
Figure 5F:
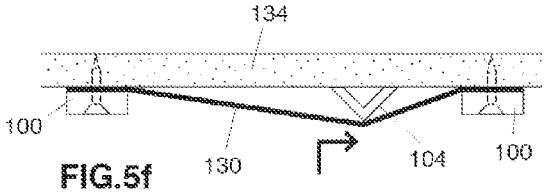
Figure 5G:
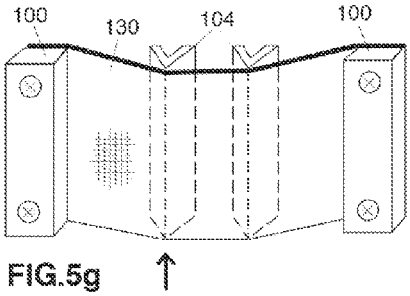
Figure 5H:
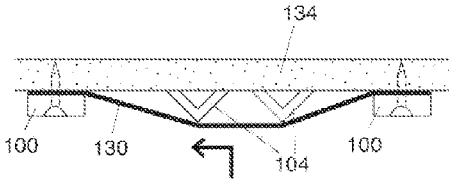
Figure 5I:
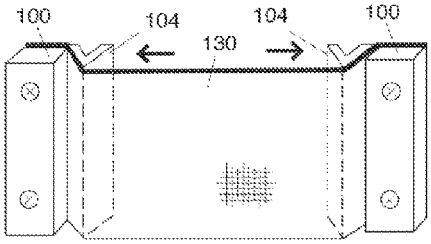
Figure 5J:
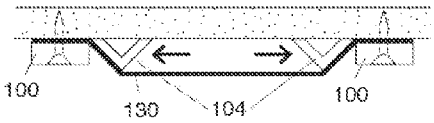

FIGS. 5*a*-5*j* illustrate the mounting of the canvas 130, wherein the image is in a horizontal (landscape) mode. As shown in FIGS. 5*a*-5*b*, canvas sheet 130 is rolled up for easier handling. At this stage, the small elongated frame members 100 are already adhered to the opposing first and second canvas edges, as demonstrated earlier in FIGS. 4*a*-4*d*. With one hand holding the rolled up canvas (hand not shown), the first (right) elongated frame 100 secured at or near the first edge of the canvas 130 is mounted to the wall with screws 122. In case of larger displays, it would be helpful at this stage to first locate a perfect vertical line, along which the first elongated frame 100 should be mounted. This would ensure that the display will be in a near perfect horizontal position once assembled. This can be easily done by the technique known as "plumb line," which employs a piece of string with a small but heavy object attached at the bottom of it. When held up, the string forms a perfect vertical line. FIGS. 5*c*-5*d* show the mounting of the second (left) elongated frame 100, which is secured at or near the opposing second canvas edge, to the wall 134, using wall screws 122. In the next step, FIGS. 5*e*-5*f* illustrate one of the small elongated tension members 104 being inserted in between the canvas 130 and the wall 134. Unlike in the vertical mounting, it is more important in a horizontally oriented canvas to insert one tensioner at the time, and sliding it towards one side in order to firmly secure it and thus keep it from falling, before installing the second tensioner 104. In FIGS. 5*g*-5*h*, the second small elongated tension member 104 is inserted and slid towards the opposite side from the first tensioner. In the final step illustrated in FIGS. 5*i*-5*j*, both elongated tension members 104 are gradually moved in opposite directions until they are in close proximity to the elongated frame members 100.

Figure 6A:
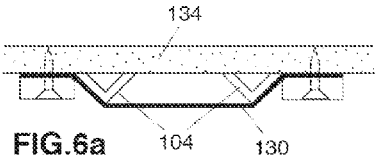
FIGS. 6*a*-6*e* are end and top elevation views illustrating the methods used for adjusting the tension of the canvas.
Figure 6B:
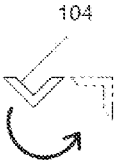
Figure 6C:
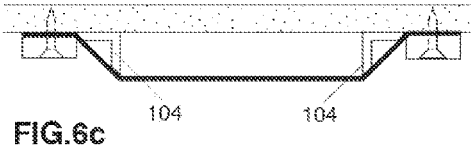
Figure 6D:
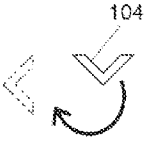
Figure 6E:
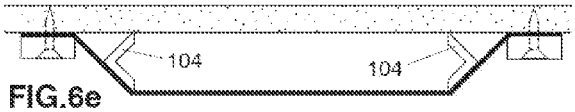

FIGS. 6*a*-6*e* illustrate the ability of the V-shaped tension member 104 to increase the tension in the canvas sheet 130 by simply rotating into three different level positions. The longer the canvas 130 is, the greater the height (depth) of the tensioners 104 might be needed to stretch it into a tauter surface. FIG. 6*a* is a top side elevation view showing the small elongated V-shaped tension member 104 in its "low position," when it is resting with both legs on the wall 134. This "low position" would be suitable for stretching mainly small to medium length canvases. FIG. 6*b* is an end view showing the elongated V-shaped tensioner 104 increasing its height (depth) by rotating until it rests on the supporting surface with one of its elongated flat sides. This will be referred to as a "medium position." FIG. 6*c* is a top side elevation view illustrating such use of the "medium position" tensioner 104 in a medium length display. Lastly, in FIG. 6*d*, an end side view, V-shaped tensioner 104 achieves its greatest height (depth) by rotating into a vertical position, with one of its legs resting on one surface (wall 134) and the other one in contact with the opposing surface (canvas sheet 130). This will be referred to as a "high position." The top side elevation view of FIG. 6*e* illustrates this "high position" of the tensioner 104 in a long canvas display. The three levels of height (depth) should be sufficient enough to stretch canvas displays of most lengths.

Figure 7A:
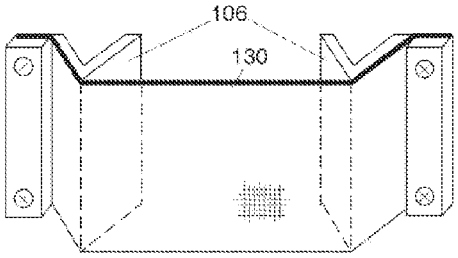
FIGS. 7*a*-7*b* are front isometric and top side elevation view for illustrating horizontally mounted canvas, wherein the frames and tensioners are of different aspect ratio.
Figure 7B:
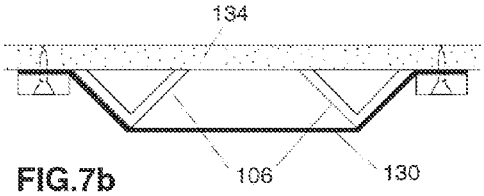
Figure 7C:
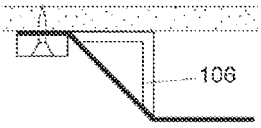
FIGS. 7*c*-7*d* are partial top side elevation views illustrating the methods used for adjusting the depth of the canvas.
Figure 7D:
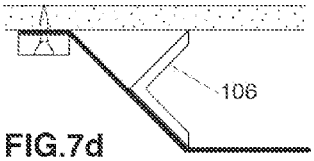

FIGS. 7*a*-7*d* employ the same principles of differently leveled tensioners, but this time a large V-shaped tension member 106 is used. Large elongated tension members 106 refer to any tensioners whose height (depth) is greater than 1.3 cm (0.5 inches) and the width is greater than 2.5 cm (1 inch). The purpose here is to create a display with image sides or edges being viewable at different heights (depths). This resembles the popular "gallery wrap" method, widely used by standard four-sided stretcher frames. Employing larger tension members 106 protrudes the canvas 130 further from the wall 134, creating almost a 3-D like structure, appearing to rise from the wall, displaying not only the frontal view but also the side views of the artwork. A plurality of removable elongated tension members 106 may be used for various effects and for different sized artwork. Having only one elongated tension member 106 between the frame members will usually create an angled canvas 130 with the tension member 106 at the vertex of the canvas. Having a first and second elongated tension member positioned near the frame members (such as illustrated in FIGS. 7*a* and 7*b*) would create a mounted canvas where the canvas primarily is displayed on a single plane. Additional tension members 106 of various sizes would allow the user to display the canvas on multiple planes. As a general matter, in most situations the user would place the various tension members 106 parallel to each other and parallel to the frame members 100. In addition, the removable elongated tension members 106 may be spaced from the other and substantially spaced from both the first and second elongated frame members. The height of the tension members may have a height greater than that of at least one of the elongated frame members and in some embodiments individual elongated tension members may have different heights compared to each other. FIG. 7*a* illustrates such display in a front isometric view, wherein the large elongated tension members 106 are in its "low position." FIG. 7*b* illustrates the same in a top side elevation view. In the partial top side elevation view of FIG. 7*c*, the tensioner 106 is rotated into its "medium position," creating a thicker side (edge) of the display. FIG. 7*d* is a partial top side view of the tensioner 106 in its "high position," creating the greatest depth of the displayed image. With standard gallery wraps, the frames need to be manufactured in different depths to give the consumer the desired thickness (depth) of their canvas picture. As can be seen in these illustrations, the desired depth can be easily achieved by simple rotation of the V-shaped tension members 106. In general, various relief heights and display looks can be achieved by changing the depth of the outer frame elements versus the depth of the removable tension elements.

Figure 8A:
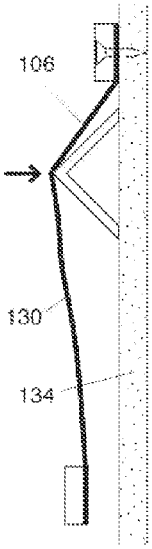
FIGS. 8*a*-8*d* are right side elevation views illustrating the method of mounting canvas to a wall in a vertical position, wherein the frames and tensioners are of different aspect ratio.
Figure 8B:
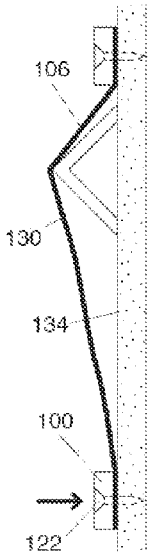
Figure 8C:
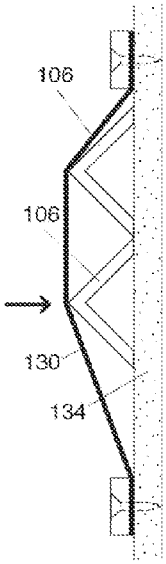
Figure 8D:
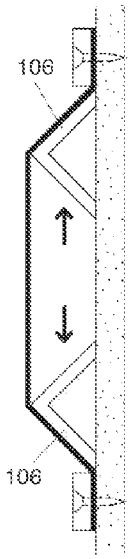

FIGS. 8*a*-8*d* are a series of right side elevation views for illustrating the vertical mounting method wherein the large elongated tension members 106 in "low position" are used. Since here a bigger space is needed between the wall 134 and the sheet 130 in order to insert the large elongated tension members 106, the steps differ slightly from the previous methods. In FIG. 8*a*, the first (top) side of the canvas with small elongated frame member 100 has been screwed to the wall 134. The first tension member 106 is inserted under the canvas 130 near the first (top) frame member 100, while the second (bottom) edge of the sheet 130 is being extended as far as it allows, without forceful overstretching. The first tension member 106 will not be displaced as this produces a force or pressure imposed by the sheet 130 acting downward on the tensioner to fix the position of the tensioner 106. In FIG. 8*b*, the second (bottom) elongated frame member 100 is fixed to the wall by screws 122. Sufficient space will remain for the insertion of the second tension member 106 to be placed between the canvas 130 and the wall 134, as shown in FIG. 8*c*. Both elongated tension members 106 are eventually slid in the direction of the elongated frame members 100 to create the necessary tautness, as shown in FIG. 8*d*.

Figure 9A:
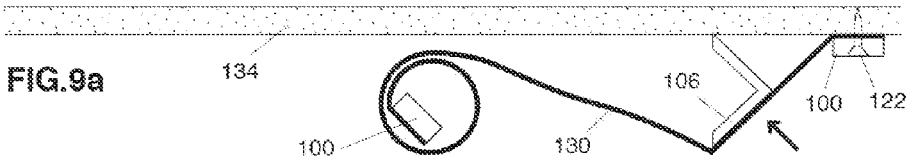
FIGS. 9*a*-9*c* are top side elevation views illustrating the method of mounting canvas to a wall in a horizontal position, wherein the frames and tensioners are of different aspect ratio.
Figure 9B:
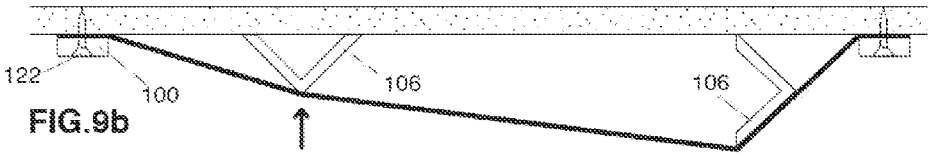
Figure 9C:
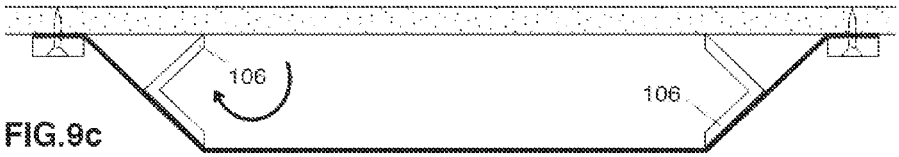

FIGS. 9*a*-9*c* show the similar mounting method in top side elevation view, this time in a horizontal positioning of the canvas, using tensioners 106 in its "high position" to install a more protruding display with thicker sides. In FIG. 9*a*, the left side of the sheet 130 with the frame member 100 already attached at or near the first canvas edge, is rolled up and held with a hand (not shown) while the right side of the sheet 130 with small frame 100 attached at or near the opposing canvas edge is fixed to the wall 134 using the screws 122. The first elongated tensioner 106 is placed near or next to the fixed edge in its "high" position and the sheet 130 is gradually extended towards the left side while unrolling. Again, as illustrated in FIG. 9*b*, the sheet is extended as far as it allows without forceful overstretching and the left side is screwed to the wall. The second elongated tensioner 106 is then placed under the sheet 130 near the left side in its "low position." In FIG. 9*c* the left tension member 106 is gradually rotated into a "high position" and then slid towards the left side until the necessary tautness is achieved. However, depending on the personal preference, the user may choose to insert the first tensioner 106 near or adjacent to the second (left) small frame 100 instead of the first (right) small frame 100. This process illustrates that many different ways can be employed to achieve the necessary results, and it should be noted, that these methods of placements of the tension members 106 at particular distances from the elongated frame members 100 and its levels of position might vary depending on personal preference and on the length of the canvas sheets 130 being installed.

Figure 10A:
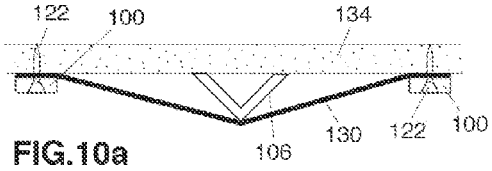
FIGS. 10*a*-10*f* are top side elevation and front isometric views of the apparatus in a multi-planar display, displaying canvas with two viewable sides (planes)
Figure 10B:
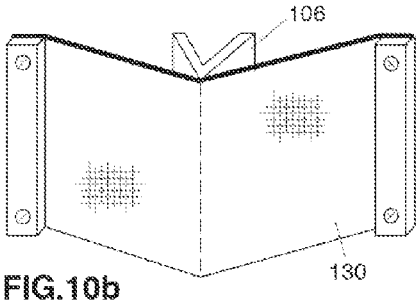
Figure 10C:
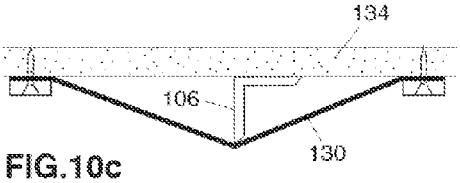
Figure 10D:
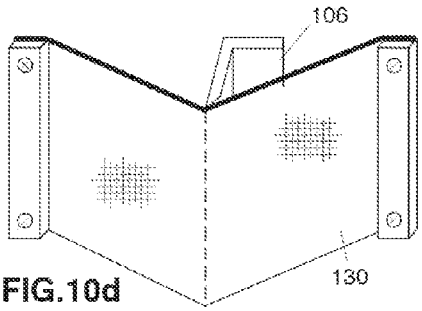
Figure 10E:
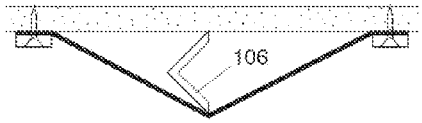
Figure 10F:
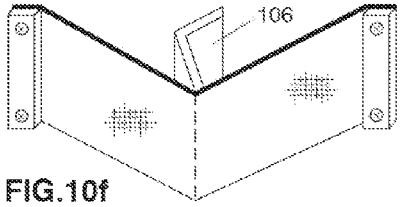

FIGS. 10*a*-10*f* are a collection of top side elevation and front isometric views, wherein the apparatus employs just one large elongated tension member 106. The canvas sheet 130 is displayed in a 3-D like structure, with the single tensioner 106 dividing the sheet 130 into two viewable sides or planes, becoming a multi-planar display. The degree of angle between the two sides (planes) can vary depending on positioning of the tension member 106. FIGS. 10*a*-10*b* show the tensioner 106 in its "low position" with the lowest angle transition between the two viewable canvas sides. FIGS. 10*c*-10*d* illustrate the tensioner 106 in a "medium position" and in FIGS. 10*e*-10*f*, the tension member 106 is in its "high position," creating the sharpest angle between the two sides of the canvas sheet 130. Such displays would be suitable for artworks with two different images on a single canvas sheet 130. Using this configuration, the two images are on two separate planes at different viewable angles, which creates a very interesting effect.

Figure 11A:
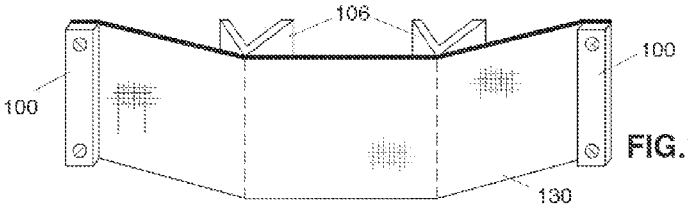
FIGS. 11*a*-11*b* are front isometric views of the apparatus in a multi-planar display, displaying canvas with three viewable sides (planes).
Figure 11B:
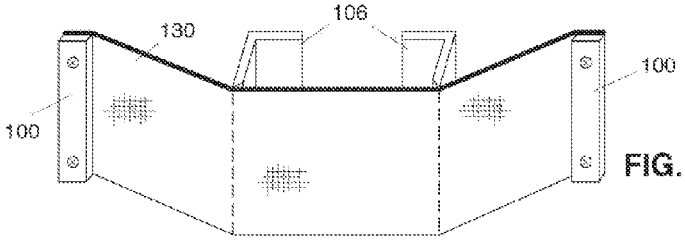

FIGS. 11*a*-11*b* are front isometric views illustrating the apparatus with canvas 130 divided into three sides (planes), all having different viewable angles. This multi-planar configuration is created using both elongated tension members 106. In FIG. 11*a*, the tensioners 106 are in its "low position" and in FIG. 11*b* the tension members 106 are in a "medium position," creating more protruding angles. Such displays would be suitable for artworks with three different images on a single sheet 130, dividing or separating them each into a different viewable angle. However, this would also work with a single continuous image, such as a panoramic landscape, giving the image a bas relief like feel.

Figure 12A:
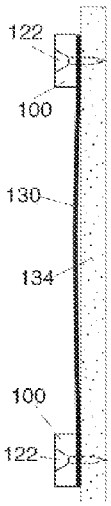
FIGS. 12*a*-12*d* are right side elevation views of a vertically mounted apparatus, illustrating the method of installing a multi-planar display with two viewable sides (planes)
Figure 12B:
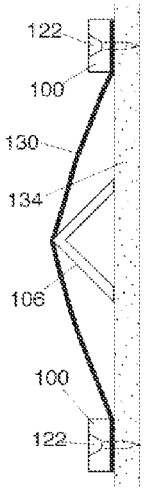
Figure 12C:
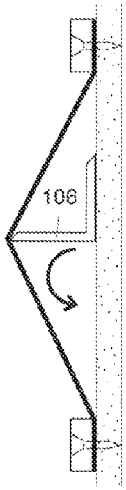
Figure 12D:
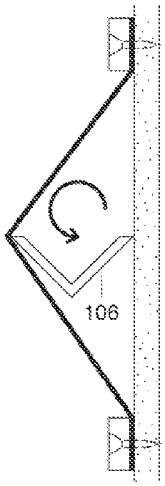

FIGS. 12*a*-12*d* are right side elevation views of the apparatus in a vertical position, illustrating the method of installing the canvas 130 with two viewable planes or sides. In FIG. 12*a*, the canvas 130 is installed in the same way as demonstrated earlier in FIGS. 4*a*-4*h*, being extended flatly on the wall. In FIG. 12*b*, a single elongated tension member 106 is inserted in the middle section, between the canvas sheet 130 and the wall 134, in its "low position." Depending on the length of the canvas 130, the tensioner 106 may have to be rotated into a "middle position" as in FIG. 12*c*. If, at this stage, the canvas is still not taut enough, the tensioner 106 is rotated further into its "high position" until the desired tautness is achieved, as shown in FIG. 12*d*.

Figure 13A:
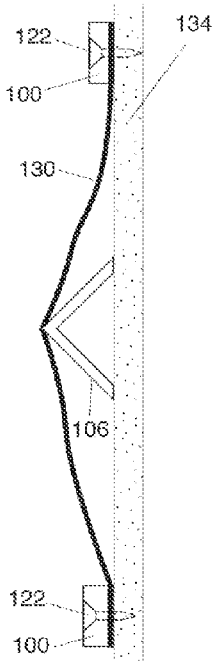
FIGS. 13*a*-13*c* are right side elevation views of vertically mounted apparatus illustrating the method of adjusting canvas tension by way of additional tension members.
Figure 13B:
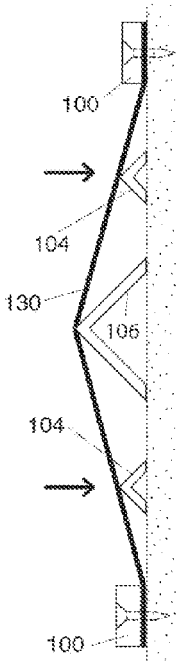
Figure 13C:
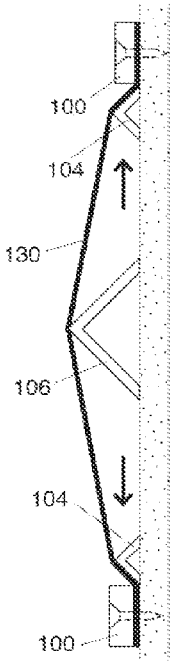

FIGS. 13*a*-13*c* are right side elevation views of a vertically mounted apparatus, demonstrating the tension adjustment in the sheet 130, but this time with the aid of the small elongated tensioners 104. If the user wishes to keep the angle between the two viewable sides at a low level and the canvas 130 is not taut enough, as illustrated in FIG. 13*a*, the small elongated tensioners 104 can be inserted between the sheet 130 and the wall 134, near the mounted edges, as in FIG. 13*b*. In FIG. 13*c* they are gradually slid toward the frame members 100 until the canvas 130 is perfectly taut. Again, depending on the length of the canvas sheet 130, the tensioners 104 may have to be rotated into higher level positions if the "low position" is not sufficient to stretch the canvas 130 into a flat surface.

Figure 14A:
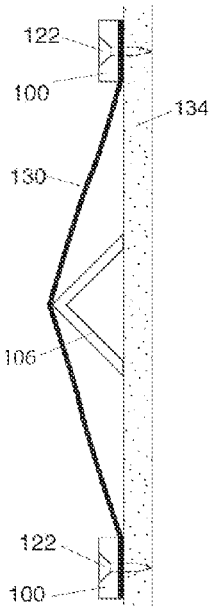
FIGS. 14*a*-14*b* are right side elevation views of vertically mounted apparatus illustrating the mounting steps necessary for achieving a particular angle between two sides.
Figure 14B:
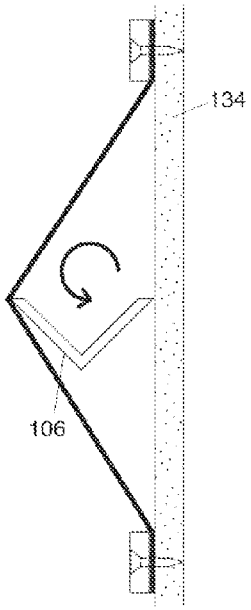

FIGS. 14*a*-14*b* are right side elevation views of a vertically mounted apparatus demonstrating the mounting steps necessary in order to achieve a particular angle between the two sides, in this case the sharpest angle. Unless it is very long, the canvas 130 should be first mounted over the tensioner 106 in its "low position" as illustrated in FIG. 14*a*. This would give enough leeway for the tensioner to rotate into a "high position" while at the same time stretching the canvas to a desired tautness, as in FIG. 14*b*.

Figure 15A:
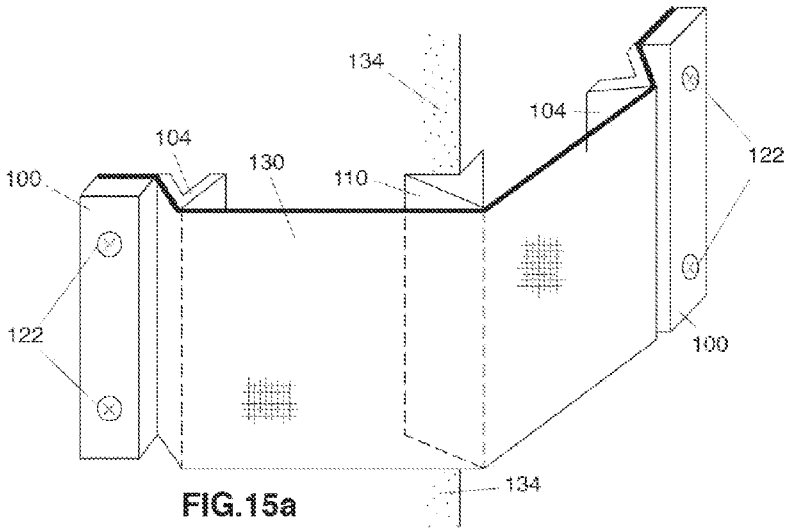
FIG. 15*a* is a front isometric view of a corner-mounted display.
Figure 15B:
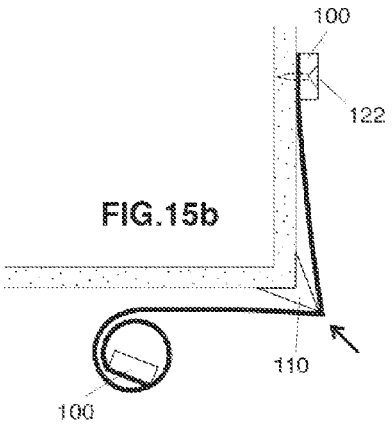
FIGS. 15*b*-15*e* are top side elevation views illustrating the method of installing a corner-framed display.
Figure 15C:
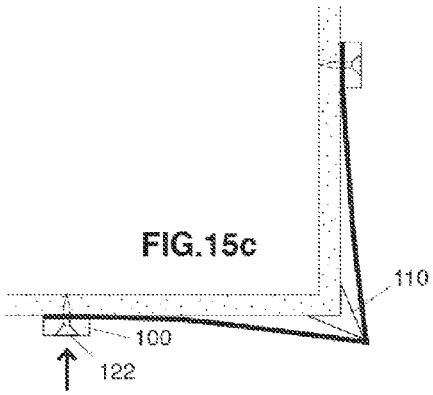
Figure 15D:
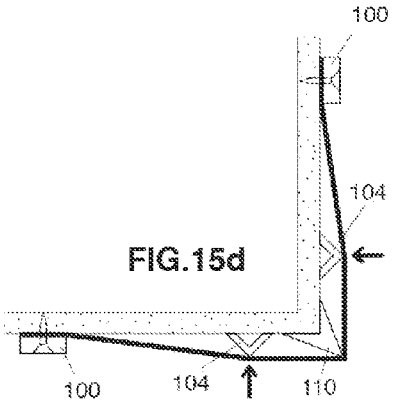
Figure 15E:
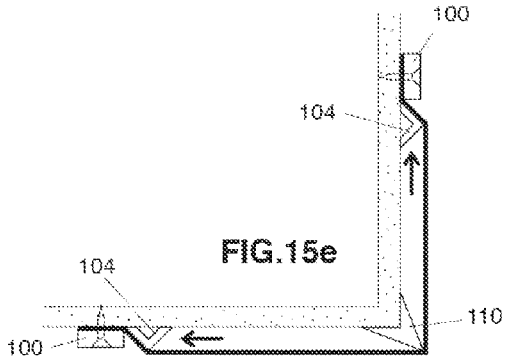

FIG. 15*a* is an isometric view of corner-mounted display, supported by kit elements in accordance with the present invention. Such interesting mounting is generally appropriate for panorama type art that is more-or-less continuous, or for art with two or more separate images on a single sheet. However, other interesting applications may occur to, and be appropriate for a user. The corner-mounted display is obtained by the placement of a corner tension member 110 on the outward (protruding) corner of two intersecting walls. The corner tension member 110 illustrated herein is shaped to fit the typical right angle (90 degree) protruding corner, in other words, the tension member 110 may have first and second surfaces substantially perpendicular to each other and joining at a corner, thus designed to fit over the corner of the wall. However, the tension member 110 can be shaped to fit other protruding wall corners intersecting at smaller or larger angles. The elongated tension member that fits over a corner may also have an outer curved region designed to space the canvas/fabric away from the sharp corner of the wall. FIGS. 15*b*-15*e* are a series of top elevation views demonstrating the steps of such corner mounting. Mounting is begun by mounting one side of the canvas 130 to one side of the wall 134 using elongated frame member 100 (secured to the first canvas edge) and wall screws 122. Thereafter, the corner tension member 110 is placed against the outward wall corner and the sheet 130 is extended over it, to the other (perpendicular) side of the wall, as illustrated in FIG. 15*b*. Again, the force of the sheet imposed downward on the tensioner keeps the corner tension element 110 in place, without the need to secure it more permanently to the wall. This will allow for positioning adjustment of the corner tension member 110 at a later time, if it will end up not being perfectly aligned under the canvas 130. FIG. 15*c* illustrates the canvas 130 extended over the corner tensioner 110, with the second elongated frame member 100 (secured to the second canvas edge) mounted to the wall. In FIG. 15*d* small elongated tension members 104 are inserted, one on each side between the wall 134 and the sheet 130. In FIG. 15*e* the tension members 104 are eventually slid toward the frame members 100 which assures that each side of the artwork is taut and properly presented.

Figure 16A:
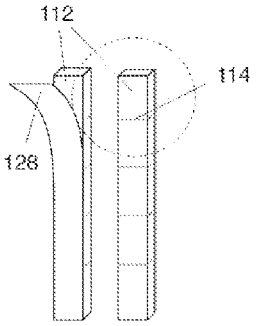
FIG. 16*a* is an isometric view of front and rear sides of an edge strip.
Figure 16B:
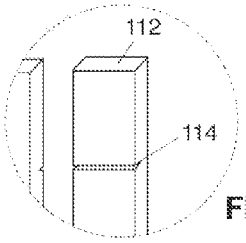
FIG. 16*b* is an enlarged isometric view of the rear side of the edge strip.
Figure 16C:
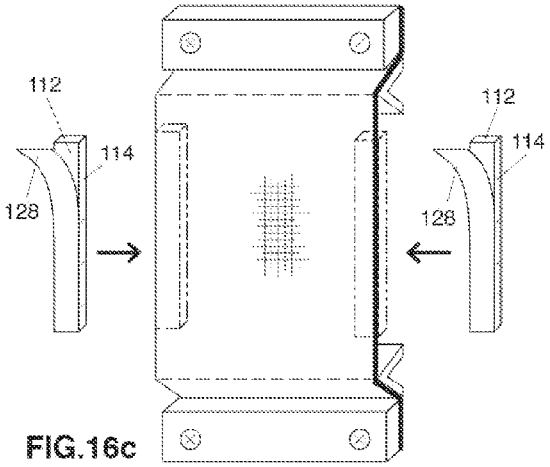
FIGS. 16*c*-16*d* are front isometric and right side elevation views of a vertical display illustrating the application of the edge strips.
Figure 16D:
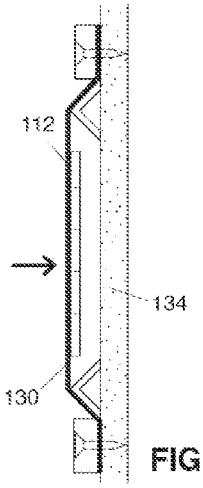

FIGS. 16*a*-16*d* FIGS. 16*a*-16*d* illustrate the application of elongated edge strips 112 to the rear surface (surface facing the wall) of the canvas sheet 130 along its unmounted third and fourth edges. There may be a plurality of elongated edge strips 112 that reinforce the loose canvas edges, which are most appropriate for larger size displays. In some embodiments only one elongated edge strip may be necessary along each unmounted canvas edge. Most fabrics such as canvas have a tendency to curl along the edges due to the fact that the tension along them is lower than in the center of the sheet, resulting in the edges being slack. The edges are also sensitive to external factors such as weather related changes in temperature and humidity. FIG. 16*a* shows the isometric views of the front and the rear sides of the elongated edge strip 112. The front side of the edge strip is lined with an adhesive strip 128 to be adhered to the back of the unmounted (loose) canvas edges. The back side can have predetermined break points or notches 114 which allow for easy sizing of edge strips 128. FIG. 16*b* is a close up isometric view of the notch 114. Ideally, kit will come with at least two such edge strips 128 per one side, and these notches 114 will allow the user to "break" the strips 112 to desired size, so they can be applied along the entire unmounted side of the canvas edge. Since most elements employed in the kit are kept to the same lengths, to facilitate shipping and to keep the apparatus simple, the edge strips 112 will be typically only as long as the tension members or frame members. And since the canvas will be usually mounted along its short sides, the length of the canvas will be longer. Thus, two or more strips 112 will be needed in order to cover the entire length of the unmounted (loose) canvas edges. FIGS. 16*c*-16*d* show the front isometric and right side elevation views respectively, of the edge strips 112 being applied to the loose side edges on the back of the canvas, one on each side. In medium sized displays this alone should be enough to keep the unmounted edges straight. However, in longer canvases the configuration can include two edge strips 112 per one side, the second one being broken to the size needed to cover the entire edge of the canvas. The edge strips are designed to be placed on opposite edges of the fabric where the elongated edge strip members are substantial parallel with each other.

Figure 17A:
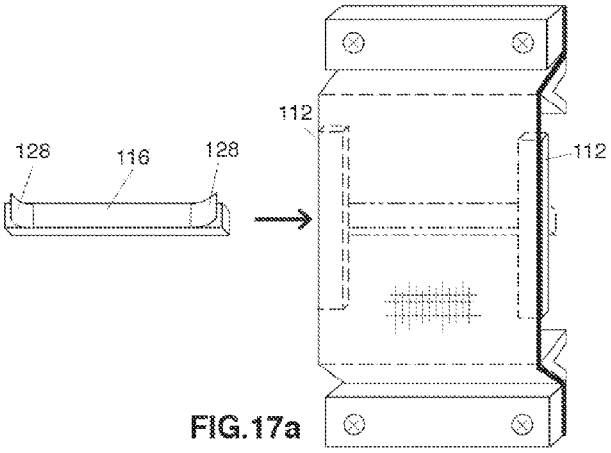
FIGS. 17*a*-17*b* are isometric and right side elevation views of a vertical display illustrating the application of a cross support strip.
Figure 17B:
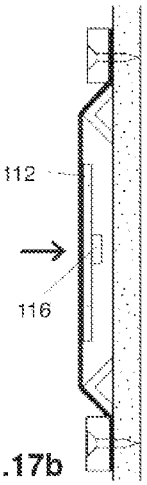

FIGS. 17*a*-17*b* show the application of a cross support strip member 116, which will further reinforce the unmounted edges. The cross support strip 116 ideally has two adhesive strips blocks 128, one on each side, which will be used to adhere it onto the bottoms (rear side) of the opposing edge strips 112. Glue, liquid adhesive, tacks, and other similar fastening means may also be employed to attach the cross support strip 116 to the edge strips 112. This should keep edge strips 112 firmly straight, keeping them from curling inward or outward, while at the same time there is no contact between the cross support strip 116 and the canvas sheet 130 itself. In longer or larger size canvases, two or more cross support strips 116 can be added for better edge support.

Figure 18A:
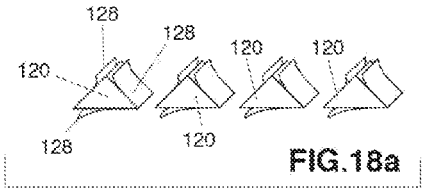
FIGS. 18*a*-18*d* are front exploded and top side elevation views of a horizontal display illustrating the application of an edge support member.
Figure 18B:
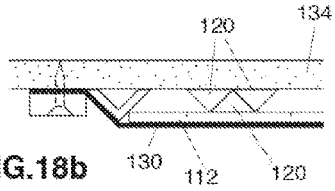
Figure 18C:
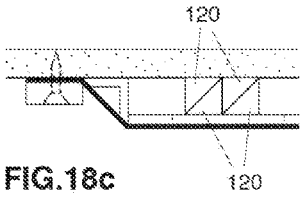
Figure 18D:
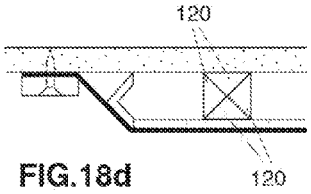

FIGS. 18*a*-18*d* illustrate the use of edge support member 120. While the previously illustrated cross support strip 116 can work well on medium to large sized artworks, as well as on displays, which are not parallel to the wall (as in FIGS. 10*a*-10*d* and 11*a*-11*b*), the edge support member 120 offers a more stable option for panoramic or extra large displays. In general, the edge support member 120 may be of any rectangular or square shape, having adhesive strip on two opposing sides, to be mounted to the wall and to the edge strips. To cope with the different variations of levels at which the canvas might be displayed, support member 120 can also consist of four separate parts, preferably each in a form of a triangle, as illustrated in isometric view of FIG. 18*a*. These four triangles can then be joined together as needed to form different levels of depth. Each of the three sides of the triangles ideally has an adhesive tape 128, which is used to fix them to each other or to the wall 134 and to the edge strips 112. FIG. 18*b* is a partial top side elevation view of the support member 120 in its "low level" position. This is achieved by arranging and joining three of the triangles horizontally, along its short sides. The support member 120 is placed in between the wall 134 and the edge strip 112, with adhesive 128 on each of the opposing sides keeping the canvas edge 112 firmly secured to the wall. FIG. 18*c* demonstrates the same, with the support member 120 in its "middle level" formation and FIG. 18*d* shows the configuration with the support member 120 in its "high level" formation. As can be seen, the addition of the edge strips 112, cross support strips 116 and edge support members 120 provide additional backing to prevent any possibility of curling or the like that would detract from the appearance of the art. While offering support at all four edges of the canvas sheet 130, the principles of simplified mounting and shipment, in contrast to the box frame, continue to be offered by the apparatus and methods, in accordance with the present invention.

Figure 19A:
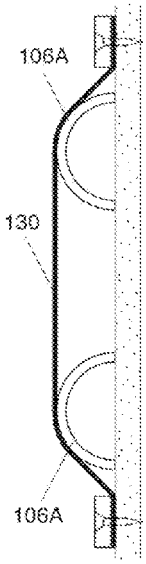
FIGS. 19*a*-19*b* are right side elevation views of a vertical display wherein the tensioners utilized comprise hollow half cylinders.
Figure 19B:
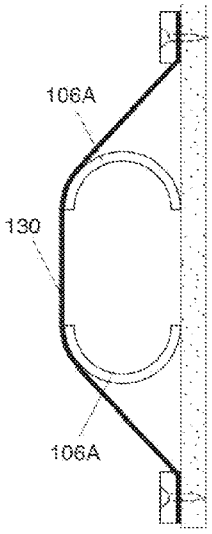
Figure 19C:
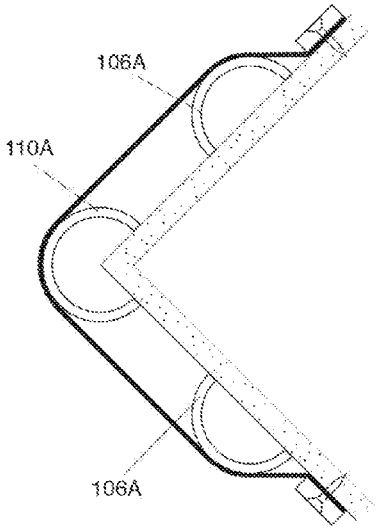
FIG. 19*c* is a top elevation view of a corner-mounted display, wherein the elements comprise hollow half-cylindrical tensioners and round corner tension member.

FIGS. 19*a*-19*b* are side elevation views wherein the apparatus utilizes tensioners with a curved region, hollow half-round tensioners 106A. They can be in a horizontal or vertical position, thus offering two different height (depth) levels at which the canvas can be stretched. The main benefit of round tensioners having a curved region is the formation of rounder or smoother edge transition in the sheet 130. This smoother transition would be more suitable for displaying one continuous image such as a landscape panorama or a long abstract display, giving it added depth and dimension for an enhanced viewing experience. FIG. 19*c* is a top side elevation view utilizing hollow half-round tensioners 106A and a hollow round corner tension member 110A in a corner-mounted display. A fully round hollow cylindrical tensioners may also be employed as a more stable option to rounded or curved transitions pictured in FIG. 19*b*.

Figure 20A:
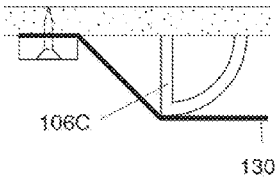
FIGS. 20*a*-20*b* are partial top side elevation views of a horizontal display comprising a hollow quarter-round tensioner.
Figure 20B:
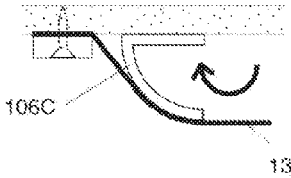

FIGS. 20*a*-20*b* are partial side elevation views of a hollow quarter-round tensioner 106C. Having a sharp as well as a curved region, it is capable of shaping both, a sharp corner edge transition as in FIG. 20*a* or a rounded corner as demonstrated in FIG. 20*b*.

Figure 21A:
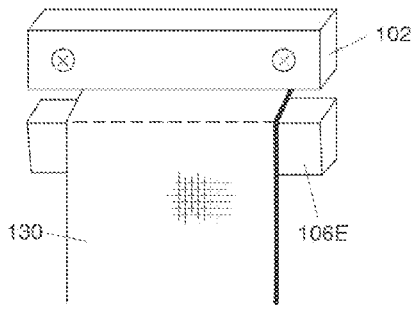
FIGS. 21*a*-21*b* are partial front isometric views of a vertical display, wherein frame members are of the different aspect ratio to the canvas and to each other.
Figure 21B:
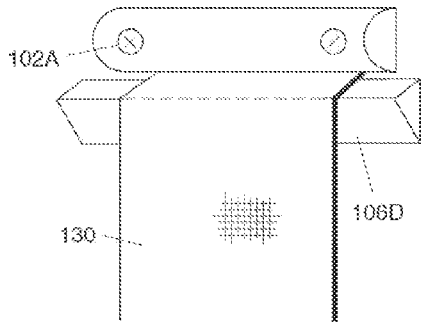

FIGS. 21*a*-21*b* are partial isometric views introducing a new embodiment of the kit employing larger elongated frame members 102 of generally rectangular shape. So far, smaller elongated frame members 100 where used throughout the figures to illustrate the basic embodiments of the apparatus. Their main function was to affix the canvas to the supporting surface, while at the same time offering some kind of decorative side treatment, thus drawing more attention to the displayed image itself. Larger elongated frame members 102, on the other hand, can offer a bolder decorative look. While smaller elongated frame members 100 can work well on most displays, larger elongated frame members 102 may offer more rigid support for large and extra-large displays. Also, the tensioners used in these figures are solid. Hollow tensioners in general have the benefit of being lighter and more compact to facilitate shipping, for example. However, solid tensioners are equally as effective when stretching the canvas to a taut surface and may offer more rigidity for larger displays. Moreover, in all the previous illustrations, the tensioners were completely hidden from the frontal view by the canvas sheet 130 and their primary purpose was to "shape" the canvas 130 and to stretch it to a taut surface. In this configuration, illustrated in FIG. 21*a*, the canvas 130 is of different, shorter aspect ratio to large elongated frames 102 and rectangular tension members 106E, exposing the view of the tensioners 106E. Thus, they too now serve as an added decorative element. In such cases, it would be appropriate, though not necessary, for both the frames and the tensioners to be made in the same color and material, to serve as a "double frame." Besides having various shapes, they can both be given various treatments which include, though are not limited to, molding, staining, painting, metallic leafing, or metallic covering. The raw wood is also an attractive look. It should be noted here, that the rectangular tensioners 106E would ideally have a slightly inward slanted top surface so that only the single top corner touches the canvas. Alternatively, a rectangularly shaped tensioner 106E can have a "lip" or a ridge in the top corner, which is used commonly in canvas-stretcher bars. This angle, lip or ridge is necessary to keep the other inside top corner from touching the canvas and forming undesirable creases in the display. For this reason, triangular or round (curved) shapes are generally more effective in that aspect. FIG. 21*b* comprises half-round elongated frame members 102A and triangular elongated tension members 106D, illustrating the potential for mixing the geometrical shapes and relative lengths of elements in order to create additional interesting decorative looks.

Figure 22A:
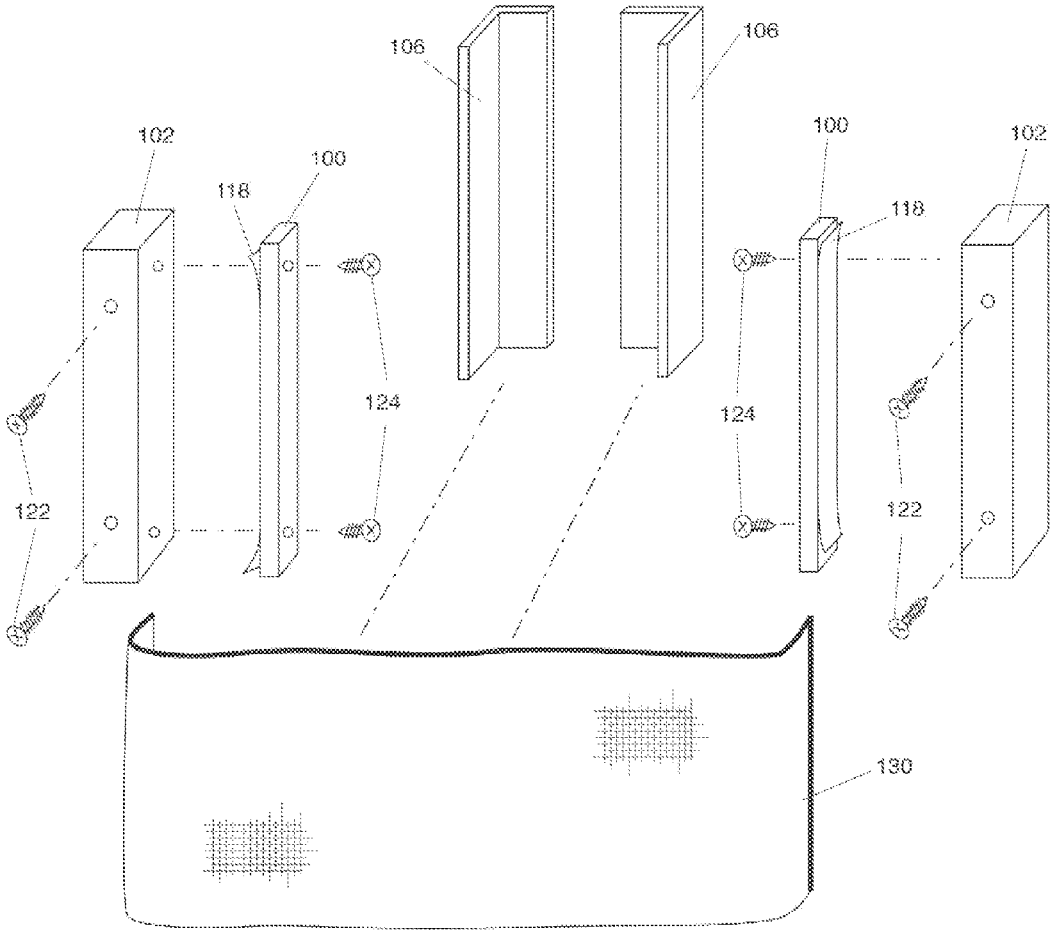
FIG. 22*a* is an exploded front isometric view of an alternative embodiment of the mounting apparatus, prior to its assembly. This embodiment comprises two frame members on each side combined with each other.

FIG. 22*a* is an exploded front isometric view of an additional embodiment of the mounting apparatus, in accordance with the present invention, prior to its assembly. This embodiment comprises a third elongated frame member and a fourth elongated frame member. The small frame members 100 are attached to the large frame members 102 with frame screws 124. The first and third elongated frame members 100 and 102 sandwich the first edge of the canvas on one side, and the second and fourth elongated frame members 100 and 102 sandwich the second edge of the canvas on the opposite side. This combination allows for additional display options of the apparatus, now being capable of supporting additional frame shapes, and having other benefits as well, as will be illustrated in the following figures.

Figure 22B:
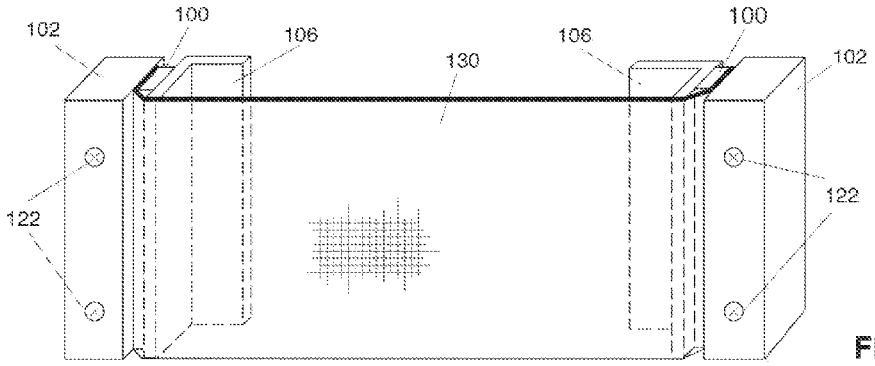
FIGS. 22*b*-22*c* are front isometric and top side elevation views of a horizontally mounted apparatus, comprising a combination of two frame members on each side.
Figure 22C:
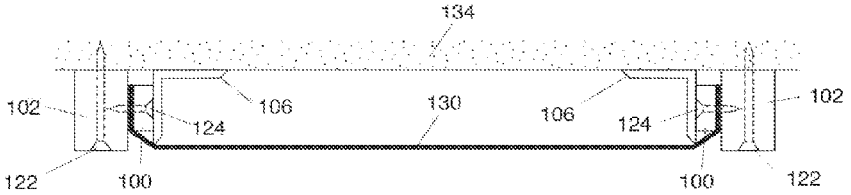

FIGS. 22*b*-22*c* are front isometric and top side elevation views of such horizontally assembled apparatus, utilizing the combination of two elongated frame members 100 and 102 on each side, with the canvas 130 edges sandwiched between them, mounted to the wall 134.

Figure 23A:
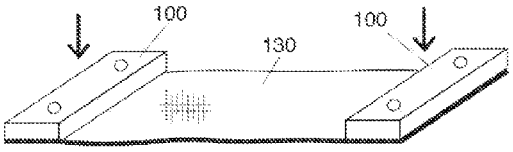
FIGS. 23*a*-23*d* are isometric and side elevation views demonstrating the attachment of the canvas sheet to the apparatus, comprising a combination of two frame members on each side.
Figure 23B:
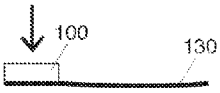
Figure 23C:
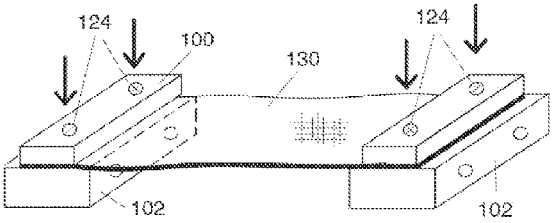
Figure 23D:
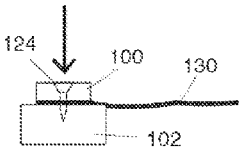
Figure 23E:
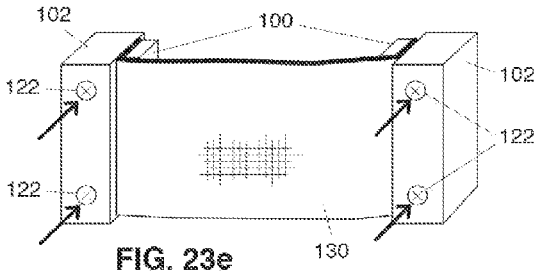
FIGS. 23*e*-23*j* illustrates the mounting of the canvas to the wall, wherein the apparatus utilized comprises a combination of two frame members on each side.
Figure 23F:
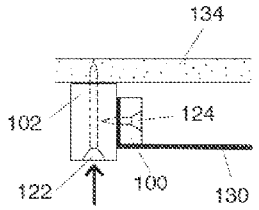
Figure 23G:
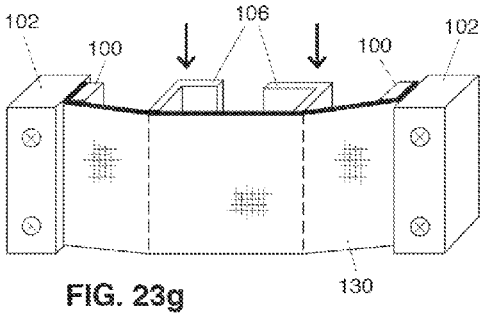
Figure 23H:
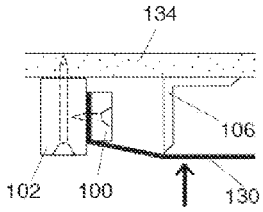
Figure 23I:
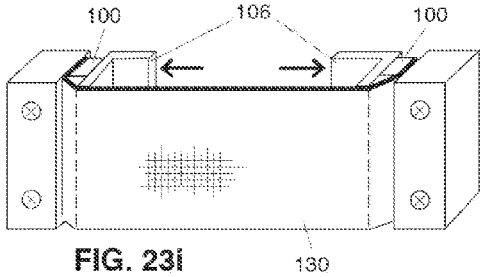
Figure 23J:
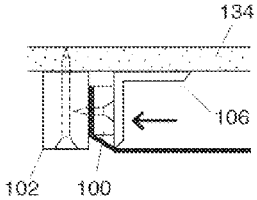

FIGS. 23*a*-23*j* illustrate the steps required for mounting the canvas 130 to the wall 134, utilizing a combination of two elongated frame members on each side, the small elongated frame member 100 and the large elongated frame member 102. In step one as illustrated in FIGS. 23*a*-23*b*, isometric and partial side view respectively, the smaller frame 100 is aligned with the canvas sheet 130 opposing first and second edges and pressed down with its front adhesive side. Unlike demonstrated earlier in FIGS. 4*a*-4*b*, this time the canvas 130 is placed down on a horizontal surface with the front surface (image side) facing down. Therefore, the frame members 100 are adhered to the edges on the rear side of the canvas sheet 130. In the next step, the small frame members 100 are attached to the side of large frame members 102 with frame screws 124, sandwiching the canvas edges between them, as shown in FIGS. 23*c*-23*d*. Besides having holes drilled through the front and back sides for wall screws 122 and adhesive strip on the back side, frame members 102 can have predrilled openings on the right and left sides as well, for optional receipt of the frame screws 124 and frame members 100 or 102, if the user wishes to join two or more elongated frames together. In FIGS. 23*e*-23*f*, the joined frame elements 100 and 102 are turned 90 degrees inward and are ready for attachment to the wall 134 with frame screws 122, one side at the time. This would be executed in the similar manner demonstrated in FIGS. 4*e*-4*l* or FIGS. 5*a*-5*d*, depending on horizontal or vertical orientation of the display. In FIGS. 23*g*-23*h*, large tensioners 106 are placed in between the wall 134 and the canvas sheet 130 and are slid in opposite directions toward the edge mountings to bring the canvas sheet 130 to a taut surface, as shown in figures. 23*i*-23*j*. Here, there is no need to stretch the canvas over the large tensioners first, because the canvas edge mounting is not at the wall level but is raised to an ideal position above the wall 134 level in which it can receive the large tensioners 106 as is. This, in a way, simplifies the installation.

Figure 24A:
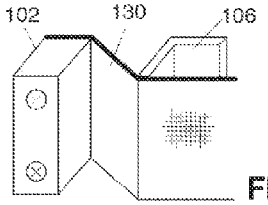
FIGS. 24*a*-24*b* are a partial front isometric and partial top elevation views illustrating the canvas side gap.
Figure 24B:
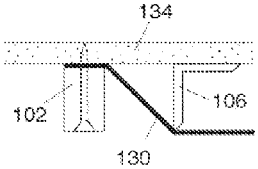

In FIGS. 24*a*-24*b* partial isometric views, the canvas 130 is attached directly to the large elongated frame member 102. In such configuration, a canvas side edge (or canvas gap between the large frame member and large tensioner) is larger and more visible than in the previous configuration seen in FIG. 23*j*, where only minimal canvas side edge is visible. In FIGS. 24*a*-24*b* the large tensioner 106 cannot be pushed closer to the frame member 102, leaving a big side "gap." For some users, this will be an acceptable or even desired look, but for those who would prefer the minimal side gap, the previous configuration shown in FIGS. 23*i*-23*j* would be more suitable.

Figure 25A:
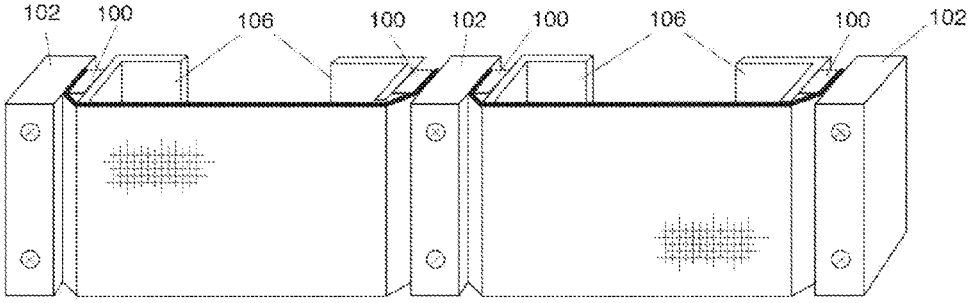
FIGS. 25*a*-25*b* are isometric and partial top side elevation view of a horizontally mounted multi-panel arrangement.
Figure 25B:
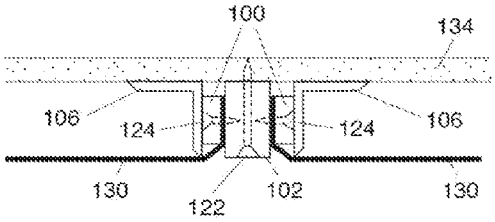

FIGS. 25*a*-25*b*, illustrate an isometric and partial side elevation view respectively, of an optional multi-panel arrangement of canvas sheets 130. The attractive side-by-side presentation of multiple canvas displays is obtained by employing a plurality of elongated frame members, and by the "sharing" of a frame member 102 between adjacent sheet edge mountings. Here, smaller frame members 100, are secured to the larger frame member 102 on both sides with screws 124. In addition to the two elongated frame members 102, a third frame member 102 is mounted to the wall, and multiple fabrics are arranged together, where at least one of the elongated frame members 102 attaches more than one canvas. The center elongated frame member 102 serves as an attachment point to the left edge of a first canvas, and the right edge of a second canvas. In the herein illustrated multi-panel configuration, the first and second canvas sheets 130 are secured to the frame members 102 via additional frame members 100, but it is also possible to secure multiple canvas sheets 130 to the frame members 102 directly, for example by stapling and the like.

Figure 26A:
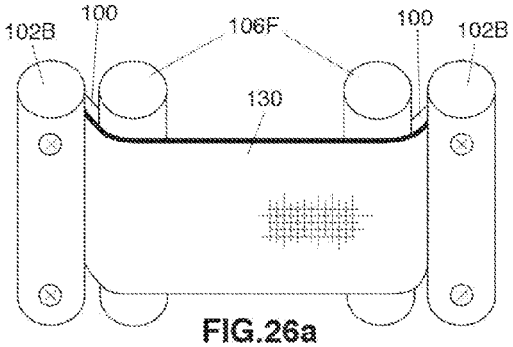
FIGS. 26*a*-26*c* are front isometric and partial top side elevation views of a horizontal display comprising solid and hollow cylindrical elements.
Figure 26B:
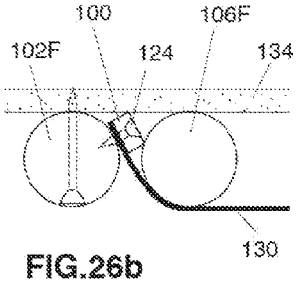
Figure 26C:
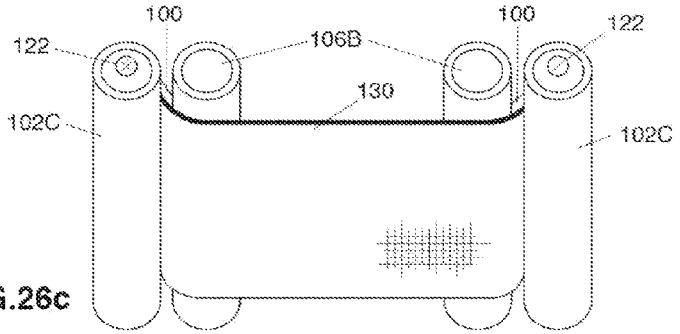

FIGS. 26*a*-26*c* are isometric and partial side views, comprising frames and tensioners in fully rounded cylindrical shapes, solid and hollow respectively. Elongated frame members used in direct fixation to the wall preferably have a flat bottom surface, in order to keep the canvas securely pinned against the wall. This would not be feasible with fully rounded elements. However, this can be achieved by first attaching the canvas 130 to the smaller elongated frame member 100 and then mounting it onto the side of a larger frame member of cylindrical shape 102B. This arrangement forms a very attractive scroll-type appearance with solid tension members 106F as illustrated in FIGS. 26*a*-26*b*. The use of hollow cylindrical frame members 102C and hollow cylindrical tensioners 106B shown in FIG. 26*c* offers the possibility of attaching hollow cylindrical frames 102C to the wall with screws 122 on the inside, within the hollow frame members 102C, thus hiding screws 122 from view, achieving yet another different look. Just as in the previous embodiments starting with FIG. 22*a*, in this embodiment there are third and fourth elongated frame members. The fabric is sandwiched between and secured to both the first elongated frame member and the third elongated frame member on the first edge of the fabric and the fabric is sandwiched between and secured to both the second elongated frame member and the fourth elongated frame member on the opposing edge of the fabric.

Figure 27A:
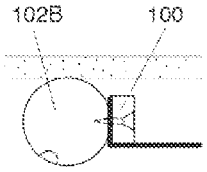
FIGS. 27*a*-27*c* are partial top side elevation views illustrating a positioning of fully round elements against the wall.
Figure 27B:
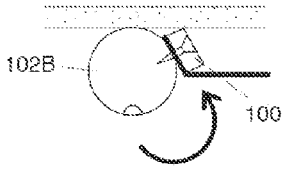
Figure 27C:
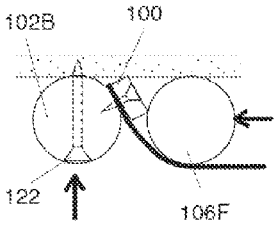

FIGS. 27*a*-27*c* are partial side elevation views illustrating the role of the small frame members 100 in the placement of the cylindrical frame members 102B against the wall 134, offering a placement support. In FIG. 27*a*, the frame member 100 is joined with the solid cylindrical frame 102B by frame screw 124 and placed against the wall. As seen in FIG. 27*b*, the cylindrical frame 102F is then rotated in the canvas direction until the edge member 100 rests on the wall. At this point, as illustrated in FIG. 27*c*, the frame member 102B is perfectly aligned for being screwed to the wall 134 and ready for receiving solid cylindrical tensioner 106F. Without the placement support of another frame element, in this case frame member 100, it would be difficult to align and securely attach fully rounded elements, in this case hollow cylindrical frame 102C, to the wall.

Figure 28A:
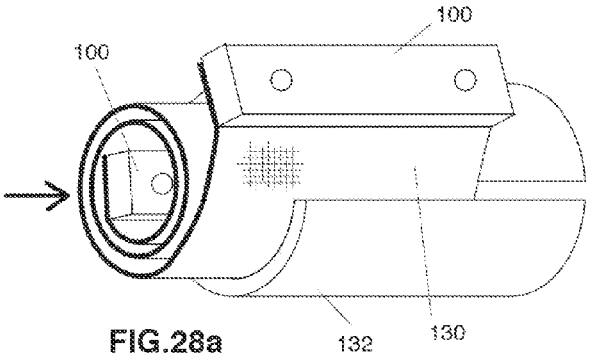
FIGS. 28*a*-28*d* are isometric and end side views illustrating the employment of a protective tube with a slit.
Figure 28B:
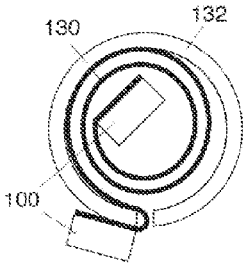
Figure 28C:
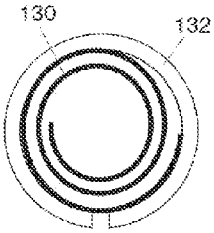
Figure 28D:
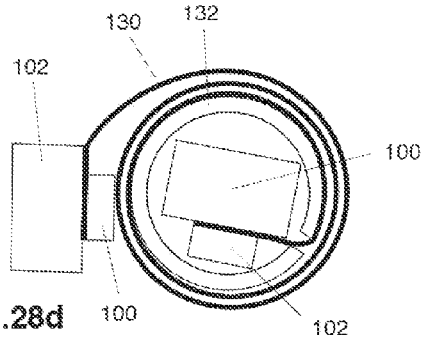

FIGS. 28*a*-28*d* are isometric and end views illustrating the placement of the rolled canvas sheet 130 into a protective container 132. The container is preferably made of cardboard and is a hollow cylindrical tube with a slit running lengthwise that permits passthrough of the fabric but prevents passthrough of the attached elongated frame members. As shown in FIGS. 28*a*-28*b*, the canvas 130 is rolled up while secured to the smaller elongated frame members 100. The rolled portion of the canvas with one elongated frame member 100 is inserted inside of the tube, while the other frame member 100 along with a portion of the sheet 130 are pushed through the tube's elongated slit. This protects the canvas 130 from being pushed against the outer edge member 100 during the transport, which could possibly damage the sheet 130. In FIG. 28*c* the canvas 130 is not attached to any frame elements and can be simply rolled up inside the tube 132. In FIG. 28*d*, the canvas sheet 130 is secured to the joined combination of small frame 100 and large frame 102. Since there is no space for the canvas sheet 130 inside the tube 132, one of the joined frames 100 and 102 is inserted inside the tube 132 and the canvas sheet 130 is rolled around the outside of the tube 132. In these ways the tube with slit 132 can easily accommodate all possible configurations, protecting canvas 130 from framing elements during a transport in the shipping container, if the canvas 130 ships with the kit.

Thus it is seen that the present invention provides a kit that offers the remote professional or non-professional purchaser of fabric-based artwork or banner displays numerous options for creative and attractive mounting of the fabric upon receipt. More importantly, the display may be mounted quickly, without substantial effort or cost, while shipment issues are relatively insignificant when compared to those encountered with the shipment of box frame mounted art. Also, box frame mountings of canvas art are limited as to size and offer little opportunity for presenting a variety of "looks." This is clearly not the case when utilizing the teachings of the present invention. The particular look will vary with the tastes of the user and the nature of the artwork. A purchaser can specify the kit elements needed to accomplish the desired look, either upon ordering the artwork or after subsequent trial mounting, and will be limited only by one's imagination The numerical values presented above are only for illustration purposes and should not be understood as limiting the present invention to the precise numbers. It is intended that the scope of the present invention not be limited by this detailed description, but by the claims and the equivalents to the claims appended hereto.

I claim:

1. A stretcher frame apparatus for mounting and stretching a fabric having a front surface and a rear surface, opposing first and second edges, and opposing third and fourth edges, the apparatus comprising:

a) a first elongated frame member and an opposing second elongated frame member, said first and second elongated frame members capable of i) being secured to the fabric, and ii) being mounted to a supporting surface;

b) a removable elongated tension member capable of i) insertion between said first and second elongated frame members, and ii) insertion between the fabric and the supporting surface;

wherein the removable elongated tension member is unsecured to the first and second elongated frame member when the first and second elongated frame members are mounted to the supporting surface; and, wherein the removable elongated tension member is capable of being spatially adjusted between the first and second elongated frame member when the first and second elongated frame members are secured to the fabric and mounted to the supporting surface, thereby permitting a user to insert, remove, or slide the removable elongated tension member after the first and second elongated frame members are secured to the fabric and mounted to the supporting surface;

wherein said removable elongated tension member, and said first and second elongated frame members are all substantially parallel to each other;

whereby insertion of said removable elongated tension member between the supporting surface and the fabric increases the distance between the supporting surface and the fabric, thereby increasing tautness of the fabric when the fabric is mounted to the supporting surface via said first and said second elongated frame members.

2. The stretcher frame apparatus of claim 1, wherein the first edge of the fabric is sandwiched between the supporting surface and said first elongated frame member, and the second edge of the fabric is sandwiched between the supporting surface and said second elongated frame member.

3. The stretcher frame apparatus of claim 1, wherein said removable elongated tension member is a plurality of removable elongated tension members.

4. The stretcher frame apparatus of claim 3, wherein at least one of said plurality of elongated tension members are triangular, V-shaped, or L-shaped.

5. The stretcher frame apparatus of claim 3, wherein at least one of said plurality of elongated tension members has a curved region.

6. The stretcher frame apparatus of claim 3, wherein said plurality of removable elongated tension members includes at least a first removable elongated tension member and a second removable elongated tension member, said first removable elongated tension member having a height greater than said second elongated tension member.

7. The stretcher frame apparatus of claim 3, wherein at least one of said removable elongated tension members is shaped to fit around a corner of the supporting surface.

8. The stretcher frame apparatus of claim 7, wherein at least one of said removable elongated tension members has first and second surfaces substantially perpendicular to each other and joining at a corner, said first and said second surfaces of said removable elongated tension member are designed to fit over the corner of the supporting surface.

9. The stretcher frame apparatus of claim 7, wherein said removable elongated tension member has an outer curved region designed to space the fabric away from the corner of the supporting surface.

10. The stretcher frame apparatus of claim 7, wherein at least one of said removable elongated tension members has a hollow center region, whereby the corner of the supporting surface fits within said hollow center region.

11. The stretcher frame apparatus of claim 1, wherein said removable elongated tension member is a first and a second removable elongated tension member.

12. The stretcher frame apparatus of claim 11, wherein said first and second removable elongated tension members are spaced from each other, said first removable elongated member is in close proximity to said first elongated frame member and said second removable elongated tension member is in close proximity to said second elongated frame member.

13. The stretcher frame apparatus of claim 11, wherein said first and second removable elongated tension members are spaced from each other and substantially spaced from both said first and second elongated frame members; and, wherein at least one of said first and second removable elongated tension members has a height greater than at least one of said first and second elongated frame members;

thereby creating a multi-planar display when said first and second removable elongated tension member is between the supporting surface and the fabric.

14. The stretcher frame apparatus of claim 1, wherein said first removable elongated tension member has a height greater than each of said first and second elongated frame member, thereby creating a multi-planar display when said first removable elongated tension member is between the supporting surface and the fabric.

15. The stretcher frame apparatus of claim 1, wherein the stretcher frame apparatus further comprises a plurality of elongated edge strip members, each of said plurality of elongated strip members capable of attaching to the rear surface of the fabric at or near the third or fourth edge of the fabric; and, wherein the third and fourth edge of the fabric are not mounted to the supporting surface;

whereby said plurality of elongated edge strip members reinforce unmounted edges of the fabric.

16. The stretcher frame apparatus of claim 15, wherein said plurality of elongated edge strip members are a first and a second elongated edge strip member designed to be placed on opposite edges of the fabric; and, wherein said first and second elongated edge strip members are substantially parallel with each other.

17. The stretcher frame apparatus of claim 15, wherein said plurality of elongated edge strip members have a plurality predetermined breakpoints to permit a user to variably size each of said plurality of edge strip members by breaking each of said plurality of elongated edge strip members along said predetermined breakpoints.

18. The stretcher frame apparatus of claim 15, further comprising:

at least one elongated cross support strip member adjacent to at least two of said plurality of elongated edge strip members, whereby said at least one elongated cross support strip member reinforces and prevents curling of said plurality of elongated edge strip members.

19. The stretcher frame apparatus of claim 15, wherein said at least one elongated cross support member is an edge support member in contact with at least one of said plurality of elongated edge strip members, and in contact with the supporting surface when the fabric is mounted to the supporting surface.

20. The stretcher frame apparatus of claim 1, further comprising:

a third elongated frame member capable of being mounted to a supporting surface, said first and second elongated frame members designed to attach to a first fabric, and said second and third elongated frame members designed to attach to a second fabric, thereby allowing the user to mount a multi-panel arrangement of a plurality of fabrics.

21. The stretcher frame apparatus of claim 1, further comprising:

a protective container, said protective container substantially cylindrically shaped and having an elongated slit for insertion of the fabric; and, wherein said elongated slit is sized to permit passthrough of the fabric and sized to prevent passthrough of said first elongated frame member.

* * * * *